US006273546B1

(12) United States Patent
Kobayashi et al.

(10) Patent No.: US 6,273,546 B1
(45) Date of Patent: Aug. 14, 2001

(54) CAPPING UNIT HAVING A DECREASED LOAD DURING A PEELING OPERATION AND INK-JET RECORDING APPARATUS USING THE SAME

(75) Inventors: Atsushi Kobayashi; Seiji Mochizuki; Kazuhisa Kawakami; Shigenori Fukasawa; Masahiro Isono; Masahiro Nakamura; Norihiro Maruyama, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 08/980,362

(22) Filed: Nov. 28, 1997

(30) Foreign Application Priority Data

| | | |
|---|---|---|
| Nov. 29, 1996 | (JP) | 8-334603 |
| Jul. 30, 1997 | (JP) | 9-219259 |
| Jul. 30, 1997 | (JP) | 9-219260 |
| Aug. 7, 1997 | (JP) | 9-225858 |
| Aug. 7, 1997 | (JP) | 9-225859 |
| Aug. 7, 1997 | (JP) | 9-225860 |
| Aug. 7, 1997 | (JP) | 9-225861 |
| Aug. 7, 1997 | (JP) | 9-225862 |
| Aug. 7, 1997 | (JP) | 9-225863 |
| Aug. 7, 1997 | (JP) | 9-225864 |

(51) Int. Cl.[7] ..... B41J 2/165
(52) U.S. Cl. ..... 347/29; 347/30; 347/31; 347/32
(58) Field of Search ..... 347/29–32

(56) References Cited

U.S. PATENT DOCUMENTS

| | | | | |
|---|---|---|---|---|
| 5,055,856 | * | 10/1991 | Tomii et al. | 347/30 |
| 5,867,187 | * | 2/1999 | Toniolo | 347/32 |
| 5,898,444 | * | 4/1999 | Kobayashi et al. | 347/29 |

FOREIGN PATENT DOCUMENTS

| | | | | |
|---|---|---|---|---|
| 0 452 119 | | 10/1991 | (EP) | B41J/2/165 |
| 0 576 033 | | 12/1993 | (EP) | B41J/2/165 |
| 0 604 068 | | 6/1994 | (EP) | B41J/2/165 |
| 0 653 306 | | 5/1995 | (EP) | B41J/2/165 |
| 0 744 294 | | 11/1996 | (EP) | B41J/2/165 |
| 0 867 295 | * | 9/1998 | (EP) | 347/30 |
| 59-103762 | | 6/1984 | (JP) | B41J/3/04 |
| 1-125239 | | 5/1989 | (JP) | B41J/3/04 |
| 2-13910 | | 4/1990 | (JP) | B41J/2/165 |
| 6-8460 | | 1/1994 | (JP) | B41J/2/165 |

* cited by examiner

*Primary Examiner*—Huan Tran
(74) *Attorney, Agent, or Firm*—Sughrue, Mion, Zinn, Macpeak & Seas, PLLC

(57) ABSTRACT

Cap holders (60, 70) are accommodation in a holder receiving member (40) in such a state that the cap holders are urged by springs toward the side of a recording head at two places with inclinations at angles of θ1, θ2 in the moving direction of a carriage and at an angle of θ3 in a direction perpendicular thereto. Moments are produced by giving a difference to the distance between the whole periphery of a cap and the recording head, and peeling is effected from one point, so that the sealing of the recording head and the peeling of the cap off the recording head are made compatible.

66 Claims, 29 Drawing Sheets

FIG. 24(III)
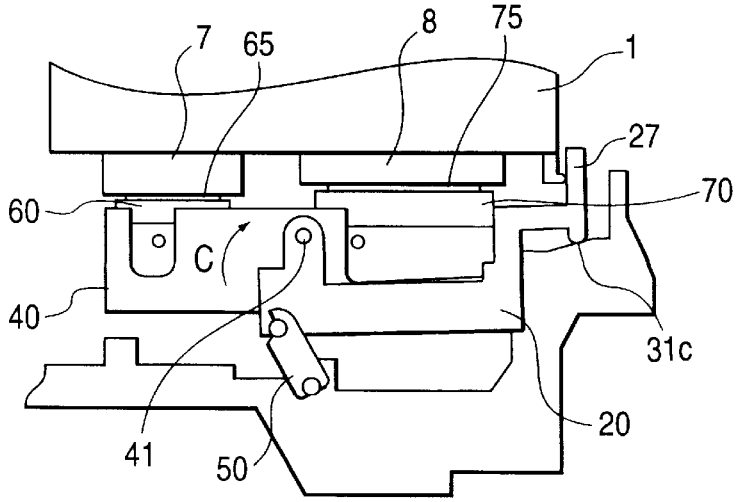

FIG. 28(III)
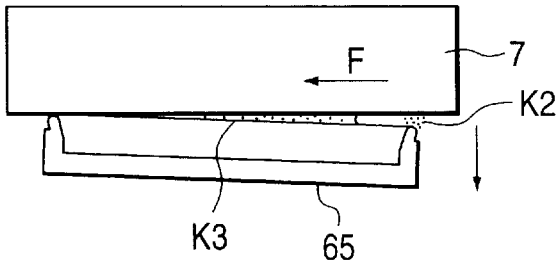

FIG. 30(III)
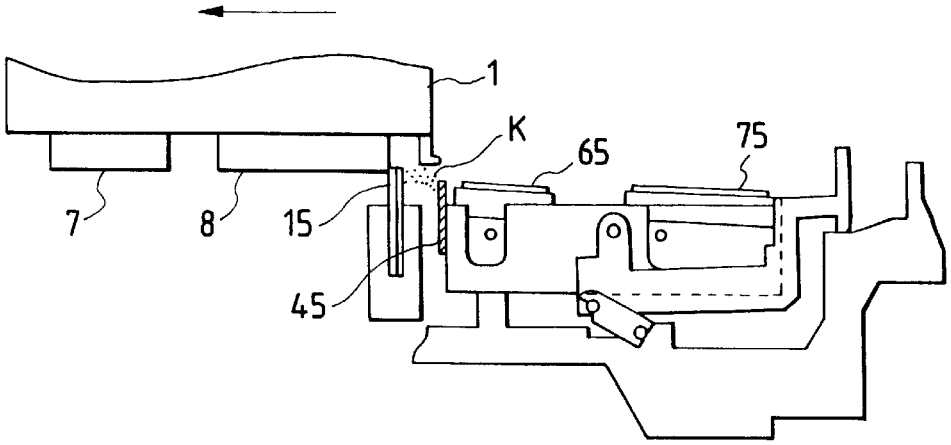

FIG. 33(III)
PRIOR ART
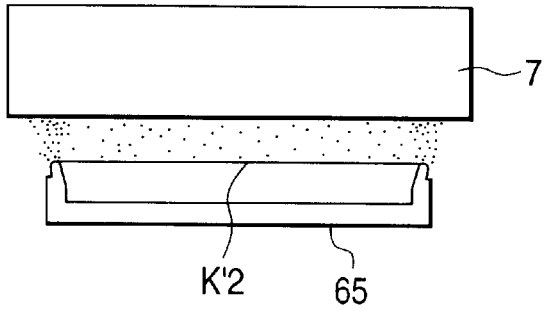

CAPPING UNIT HAVING A DECREASED LOAD DURING A PEELING OPERATION AND INK-JET RECORDING APPARATUS USING THE SAME

BACKGROUND OF THE INVENTION

1. Field of the Invention

This invention relates to a capping unit suitable for use in a recording apparatus having an ink-jet recording head which is moved in the width direction of a recording sheet, and forms images on the recording sheet or the like by jetting ink droplets according to print data.

2. Description of the Related Art

An ink-jet recording apparatus records print data on a recording sheet or the like by jetting ink droplets from nozzle openings while ink is pressurized in pressure generating chambers. However, such an ink-jet recording apparatus has potential inconveniences resulting in poor printing quality due to an increase in ink viscosity caused by the evaporation of an ink solvent from the nozzle openings, the solidified ink and dust sticking to the nozzle openings and the penetration of air bubbles therethrough. Therefore, the ink-jet recording apparatus is normally provided with a capping means for sealing up the nozzle openings of a recording head during the non-printing operation and a cleaning means for cleaning a nozzle plate, if necessary.

For example, as disclosed in Unexamined Japanese Patent Publication No. Hei. 6-8460, there has been proposed a capping unit having a cap which is pressed by a recording head or a carriage for carrying the recording head to move between a non-capping position and a capping position, the capping unit being placed outside a printing area, a cam face and a cam follower for moving the cap to the side of a nozzle plate of the recording head while the recording head is kept moving from the non-capping position to the capping position.

According to the arrangement above, the carriage is only moved whereby to ensure that it is brought into resilient contact with and seals up the nozzle plate. However, the number of nozzle openings of a black recording head for jetting black ink in order to meet high-density, high-speed printing requirements and the number of nozzle openings of a color recording head for jetting three kinds of colored ink tend to increase. As the size in the paper feeding direction and the size in the width direction of paper grow larger, the size of the cap for sealing up each recording head becomes inevitably larger and the inconvenience is that the sealing capability is lowered.

Moreover, the ink penetrated between the cap and the recording head is set up because of the use of quick-drying ink and the like, thus causing the cap to rigidly stick to the recording head, and this develops the problem of necessitating a strong force of separating the cap therefrom.

Further, there is another problem arising from a decrease in sealing strength as the sealing surface varies with the head-to-head tolerance and so forth because a platen gap is caused to greatly fluctuate when characters are printed on various printing media.

There is still another problem developing from the residual ink remaining at the recording head when an attempt is made to form a thin-wall portion on the open face to secure a sealing condition by decreasing the elasticity of the cap in order to solve the problems mentioned above.

On the other hand, a tube pump is employed for a pump unit for filling the recording head with ink and supplying negative pressure to the cap at the time of cleaning in view of cost and reliability and besides part of the tube used to form the pump is directly used as a connection channel with the cap. Therefore, there still exists another problem resulting from great repulsive force of the tube, which acts as what impedes the adhesion of the cap, thus reducing the adhesion thereof because such a tube has to be placed in a limited space and is made of relatively rigid material so as to resist against the pressure applied by a roller while functioning as a pump tube.

SUMMARY OF THE INVENTION

A capping unit according to the present invention is equipped with a holder receiving member which is pressed by a recording head or a carriage for carrying the recording head and whose central portion is rotatably supported by a shaft perpendicularly intersecting the moving direction of the carriage within a plane in parallel to a plane including the moving direction of the carriage; a first and a second holder each of which is urged toward the recording head by a spring which is brought into contact with the holder receiving member at two places in the moving direction of the carriage and supported by the holder receiving member with one point on the center line on one end side as a contact point and with two points holding the center line therebetween as contact points, the distance of the one point from the surface of the recording head on the side where the two points are supported is set greater than the distance of the other two points therefrom; and a first and a second cap respectively held by the first and second holders. Thus, the cap holders are supported at three points with respect to the holder supporting member and since there is a difference of the distance to the whole periphery of the cap for the recording head, the moment generated then lets a peeling-off operation start from one point and this causes the load to be decreased.

It is therefore a primary object of the present invention to provide a capping unit capable of ensuring that one or a plurality of recording heads are sealed up and simply peeling off a cap sticking to the recording head.

It is a second object of the present invention to provide a capping unit capable of ensuring that recording sheet is sealed up and decreasing the clinging of ink to a cap.

It is a third object of the present invention to provide a ink-jet recording apparatus using such a capping unit as stated above.

BRIEF DESCRIPTION OF THE DRAWINGS

FIGS. 21(*b*) and 21(*c*) are diagrams showing the positional relations to respective pawls, respectively;

FIGS. 22(*c*) and 22(d) what arises from the positional relation between the pawl and the through-hole, respectively;

FIG. 26 is a diagram showing a state in which the recording head has moved to the capping position;

DETAILED DESCRIPTION OF THE PREFERRED EMBODIMENTS

A detailed description will subsequently be given of embodiments of the present invention with reference to the accompanying drawings.

Figure 1:
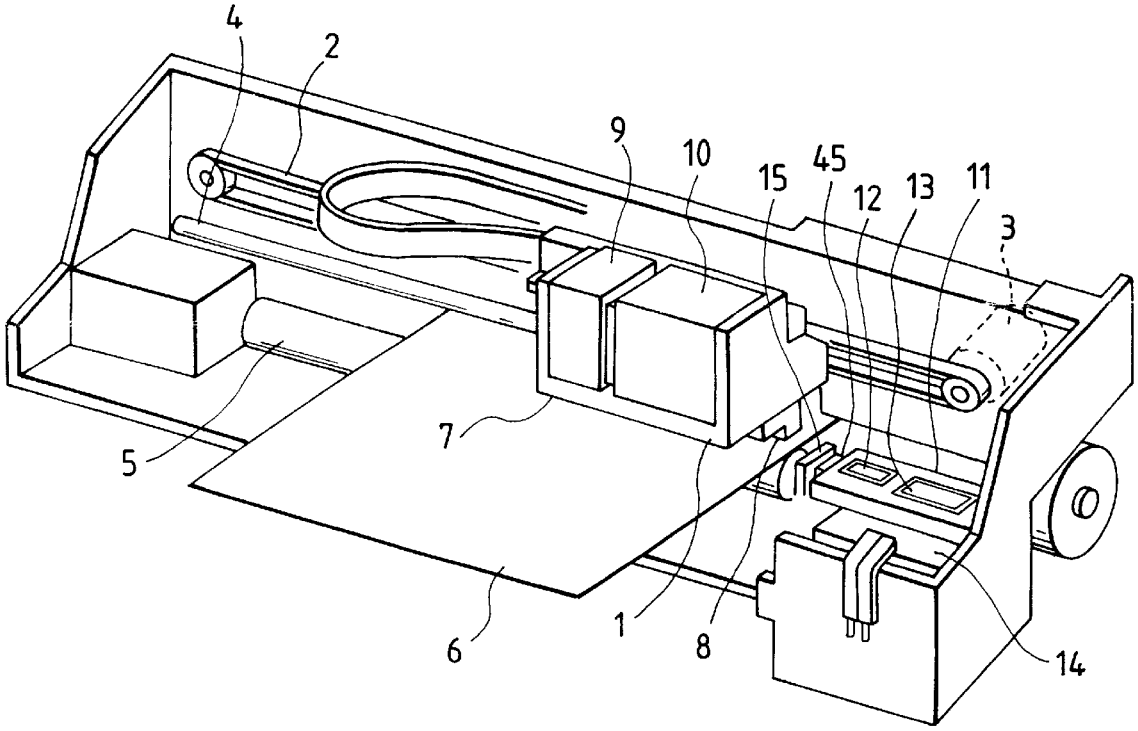
FIG. 1 is a perspective view of an ink-jet recording apparatus using a capping unit embodying the present invention.

FIG. 1 shows an embodiment of the present invention, wherein a carriage 1 is connected via a timing belt 2 to a motor 3 and adapted to move in parallel to a platen 5 by guidance of a guide member 4. An ink-jet recording head 7 for jetting black ink and an ink-jet recording head 8 for jetting color ink are installed on the opposite-to-recording-paper-6 side of the carriage 1, and the recording heads 7, 8 operate to print characters and patterns on recording sheet 6 on receiving supplies of ink from the respective ink cartridges 9, 10.

A capping unit 11 is provided with caps 12, 13 of such a size as is large enough to seal up the nozzle openings of the recording heads 7, 8 in sealing spaces independent of each other, and functions as what seals up the nozzle plates of the recording heads 7, 8 at the time of non-printing in order to prevent ink in a nozzle opening orifice from drying up and what forces ink out of the recording heads 7, 8 on receiving negative pressure from a pump unit 14 when the jet capability is recovered. A wiping blade 15 made of elastic material such as rubber and used for removing ink and ink dregs by resiliently contacting the recording heads 7, 8 is installed so that it is movable back and forth on the moving loci of the recording heads 7, 8.

Figure 2A:
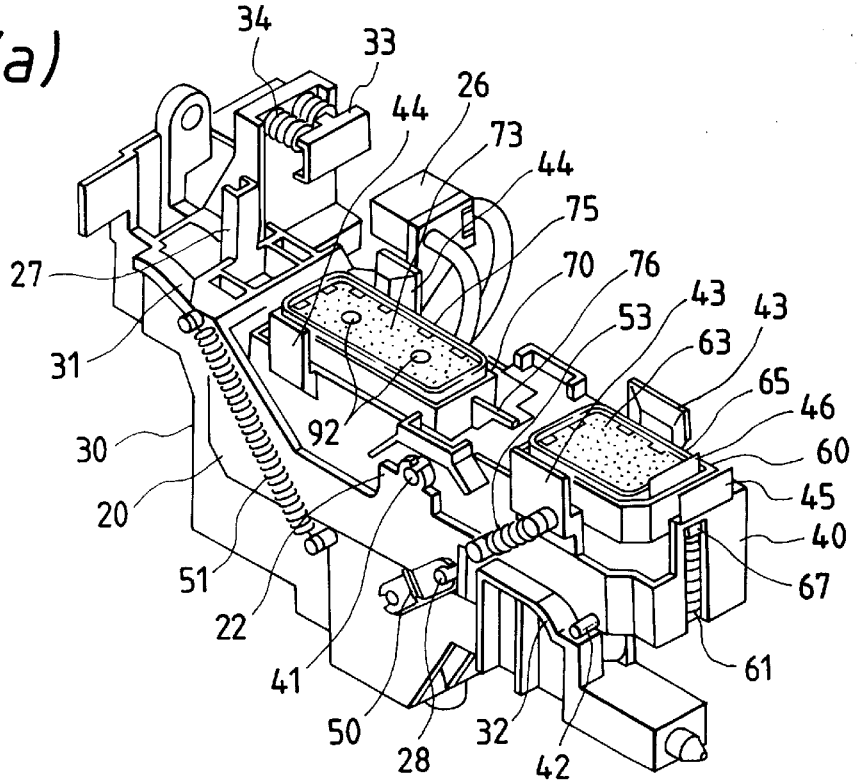
FIGS. 2(*a*) and 2(*b*) are perspective views of the capping unit as viewed from both sides according to the embodiment of the present invention.
Figure 2B:
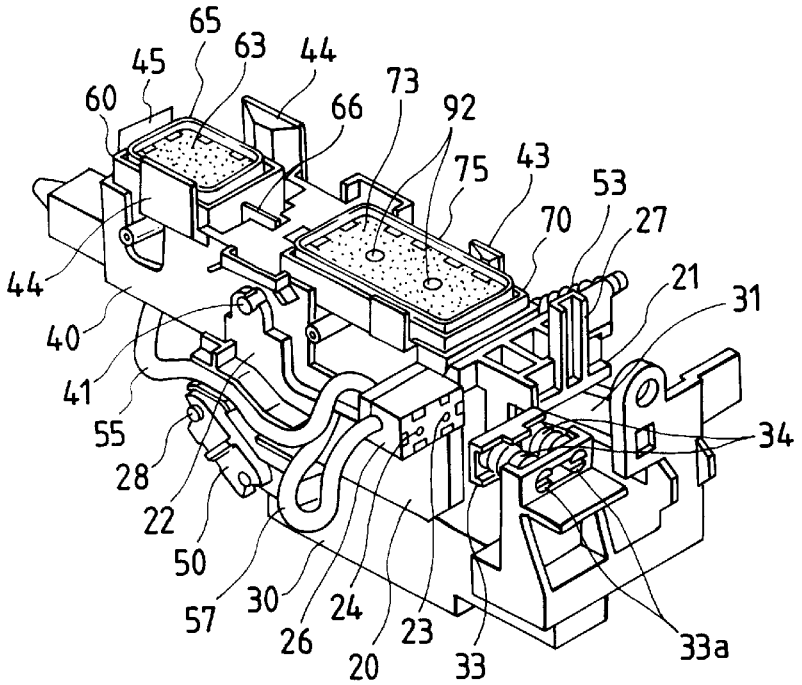
Figure 3:
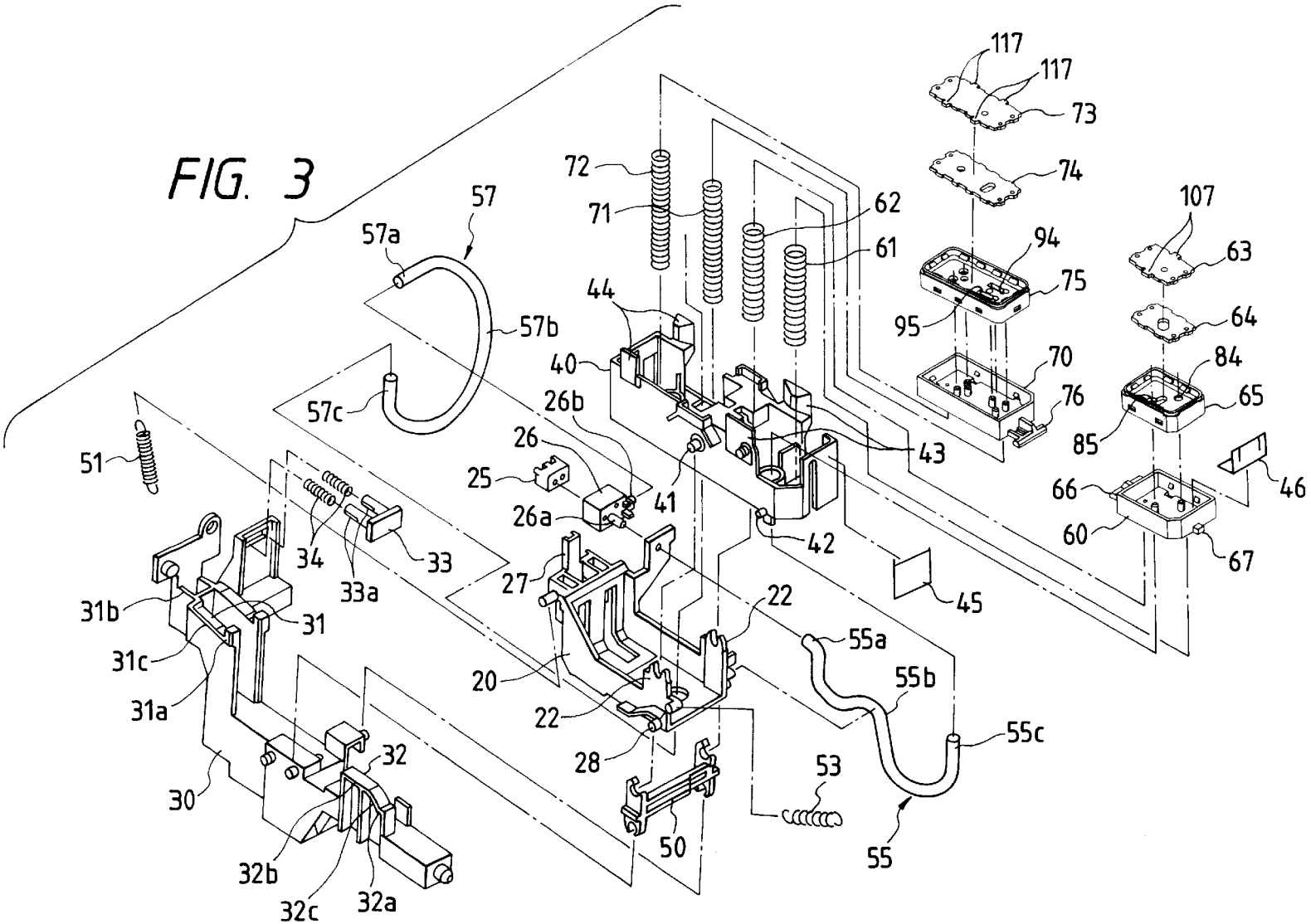
FIG. 3 is a perspective assembly drawing of the capping unit.

Referring to FIGS. 2(*a*), 2(*b*) and FIG. 3, there is given a schematic description of the capping unit 11 as embodied in the present invention. When the carriage 1 moves from a printing area to a non-printing area, a slider 20 follows the movement of the carriage 1 and is moved on the surface of a base 30 in a non-printing direction and on the recording head side, that is, in the vertical direction according to this embodiment of the present invention. The slider 20 has a contact piece 21 formed in the end portion on the non-printing area side and is supported with the first guide surface 31 of the base 30, one end of the slider 20 being supported by the other end of an arm 50 rotatably mounted on the base 30 on the front end side from the center (the right-hand side of FIG. 2(*a*) or left-hand side of FIG. 2(*b*)). The slider 20 is secured to the other end of a tension spring 51 whose one end is secured to the base 30 above the contact piece 21 and always urged in the direction of the printing area and in the direction in which it is separated from the recording heads 7, 8, that is, urged downward according to this embodiment of the present invention.

A cap holder receiving member 40 is used for accommodating a first and a second cap holder 60, 70 and its shaft 41 is placed in the central portion, preferably in a position where the moments of compression springs 61, 62 for urging the cap holder 60 and those of compression springs 71, 72 for urging the cap holder 70 are balanced. The shaft 41 is rotatably supported by a receiving portion 22 provided in a front end portion on the printing area side of the slider 20 and also always urged by a tension spring 53 stretched to the slider 20 on the printing area side toward the rear end side (the left-hand side of FIG. 2(*a*) or right-hand side of FIG. 2(*b*)), that is, in the direction of the non-printing area and in the direction in which it is separated from the recording heads 7, 8, that is, urged downward according to this embodiment of the present invention.

The first and second cap holders 60, 70 are accommodated in the cap holder receiving member 40 in such a state that it is always urged by the compression springs 61, 62 and 71, 72 separately fitted in the bottoms of the cap holders at two places in the longitudinal direction on the substantially center line of the cap holder receiving member 40 toward the recording head, that is, urged upward according to this embodiment of the present invention.

Caps 65, 75 for containing a first and a second ink absorbing sheet 63, 64 and 73, 74, each being formed of a plurality of sheets of porous material, two sheets thereof according to this embodiment of the present invention, are fitted in the respective cap holders 60, 70. The first and second ink absorbing sheets 63, 64 and 73, 74 are such that those placed closer to the recording heads 7, 8 have larger diameter pores, and are arranged so that a different in capillary force is utilized for moving ink from the surface to the bottom.

Figure 4:
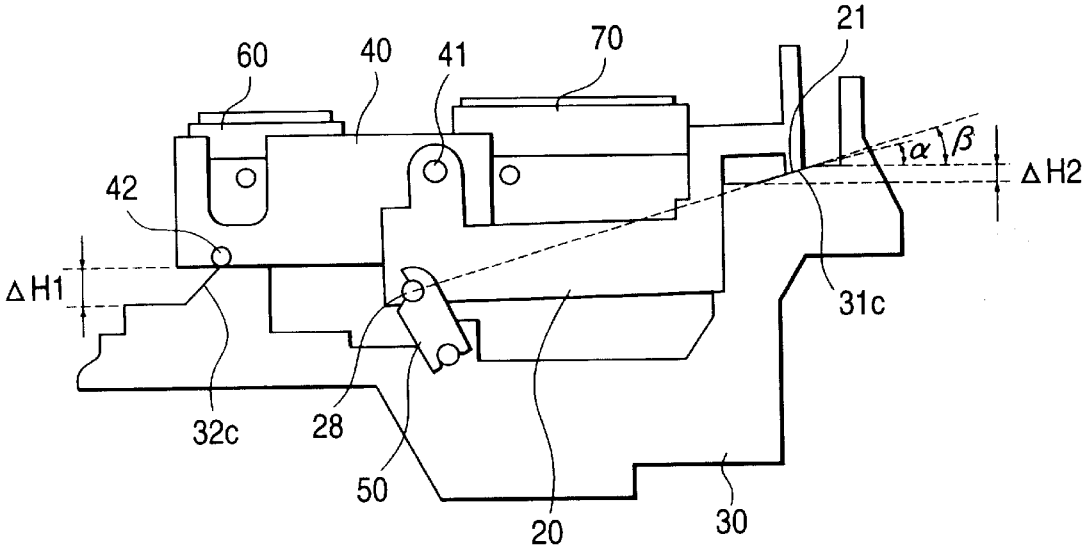
FIG. 4 is a diagram illustrating the relation among the ascending quantity of the capping unit by means of a first and a second guide surface, an angle of the first guide and the angle of the rotary shaft of slider with the first guide surface.
Figure 5A:
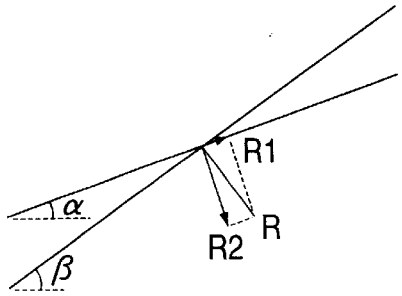
FIGS. 5(*a*) and 5(*b*) are diagrams illustrating the relation of load resistance to the angle of the first guide surface and the angle between the rotary shaft of the slide and the first guide surface.
Figure 5B:
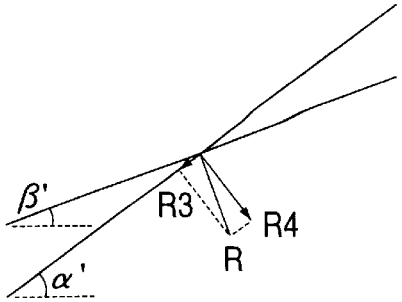

A further description will be given of each member. The base 30 has the first guide surface 31 on its rear end side and the second guide surface 32 on its front end side. There are formed three areas on the first guide surface 31; namely, a low place portion 31*a* on its front end side, a horizontal high place portion 31*b* on its rear end side and a slope portion 31*c* for connecting the former two portions 31*a*, 31*b*. Further, there are formed three areas on the second guide surface 32; namely, a low place portion 32*a* on its front end side, a horizontal high place portion 32*b* on its rear end side and a slope portion 32*c* for connecting the former two portions 32*a*, 32*b*. As shown in FIG. 4, the ascent quantity $^{66}$ H1 caused by the second guide surface 32 is set greater than the ascent quantity $^{\Delta}$H2 caused by the first guide surface 31, and an angle α with respect to the horizontal plane of the slope portion 31*c* of the first guide surface 31 is set smaller than an angle β connecting the support shaft 28 of the slider 20 and the contact piece 21. Thus, the resistance R generated when the slider 20 ascends along the slope portion 31*c* includes, as shown in FIG. 5(A), the upward-directed component R1 of the slope portion 31*c*. When the angle α with respect to the horizontal plane of the slope portion 31*c* of the first guide surface 31 conversely becomes greater than the angle β connecting the support shaft 28 of the slider 20 and the contact piece 21, the load resistance of the carriage 1 for moving the slider 20 tends to become greater since the resistance R includes, as shown in FIG. 5(B), the downward-directed component R3 of the slope portion 31*c*.

On the other hand, the cap holder receiving member 40 has a contact piece 42 to be guided by the second guide surface 32, the contact piece 42 being formed in the lower portion of the front end side. Further, guide pieces 43, 43 and 44, 44 which are brought into contact with the sides of the recording heads 7, 8 in order to guide the caps 65, 75 to predetermined positions are provided in the side portions of the cap holder receiving member 40, respectively. A separate or integral ink-splash shielding plate 45 so positioned as not to touch the recording heads 7, 8 but to be as wide as the print height of the recording heads 7, 8 is provided on the front edge face situated opposite to the wiping blade 15. The ink-splash shielding plate 45 is preferably formed of a polymer material or the like having ink absorbing properties.

The slider 20 is formed with a flag piece 27 at its rear end, the flag piece being brought into contact with the side wall of the recording head 8 or the carriage 1 and pressed thereby according to this embodiment of the present invention. A valve seat 25 having two holes 23, 24 is fixed via a holder 26 on the rear side of the side portion of the slider 20. As the slider 20 is moved close to the marginal point in the rear end portion, on the other hand, it faces a valve 33 always urged by springs 34, 34 fitted in guide shafts 33*a*, 33*a* toward the front end side, the valve being installed on the base 30 and horizontally movable back and forth in a position opposite to the valve seat.

Figure 6:
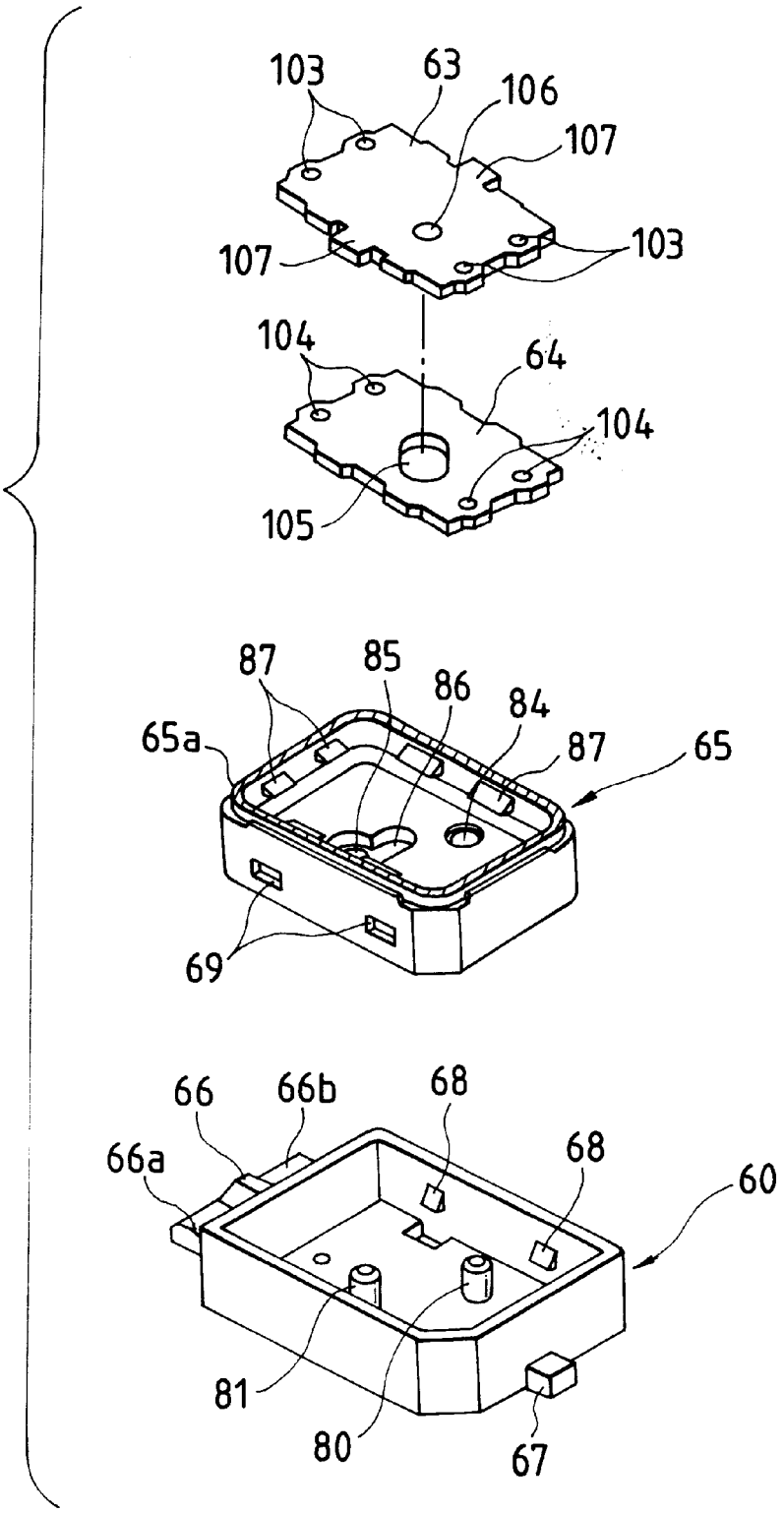
FIG. 6 is a perspective assembly drawing of a first cap embodying the present invention.
Figure 7:
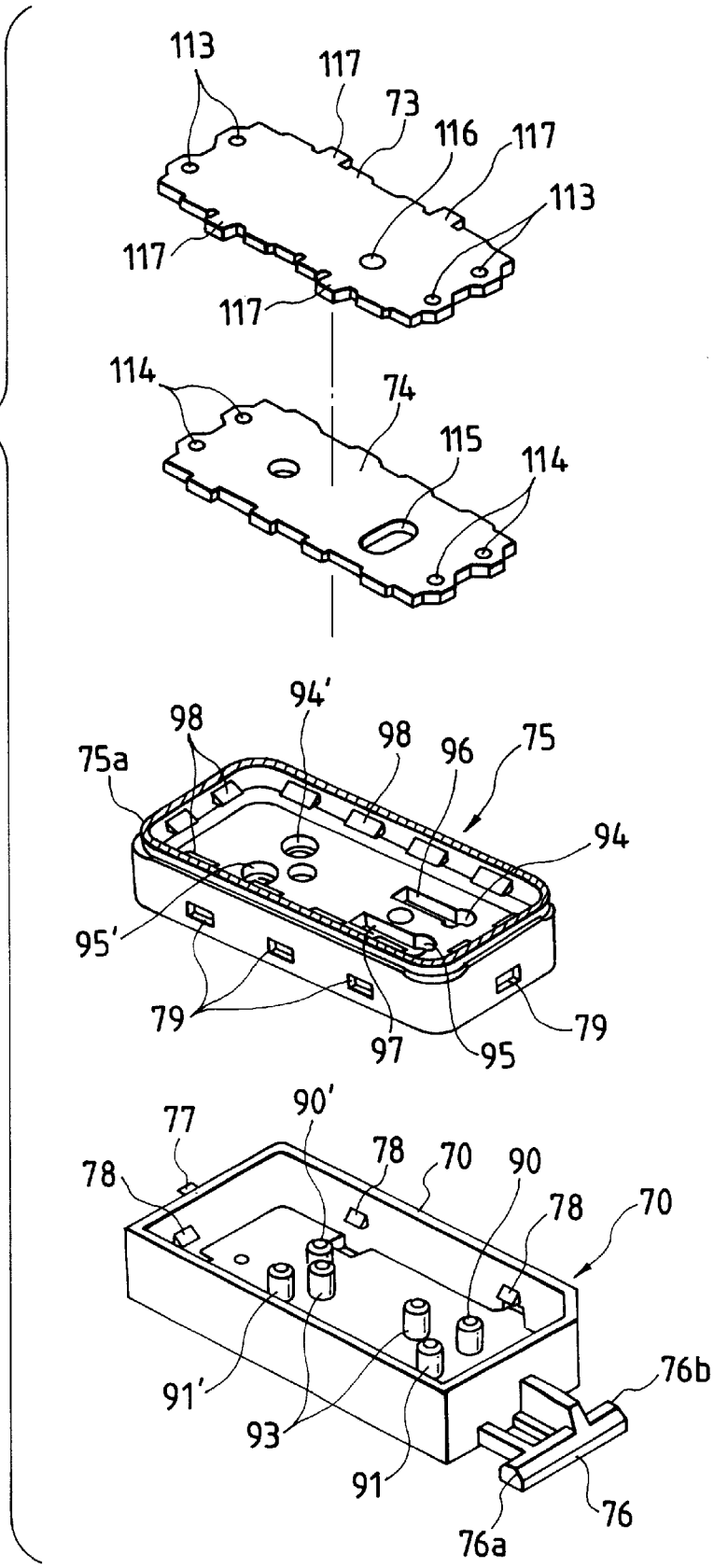
FIG. 7 is a perspective assembly drawing of a second cap embodying the present invention.

As shown in FIG. 6, the first cap holder 60 is formed with a T-shaped slip stop portion 66 on the center line on one side in the moving direction of the carriage 1 and an I-shaped slip stop portion 67 on the other side therein. As shown in FIG. 7, further, the second cap holder 70 is formed with a T-shaped slip stop portion 76 on one side in the moving direction of the carriage 1 in such a manner as to pass the center line and an I-shaped slip stop portion 77 on the other side therein. These T-shaped slip stop portions 66, 76 have branch pieces 66*a*, 66*b* and 76*a*, 76*b* extending in a direction perpendicular to the moving direction of the carriage 1, respectively. The surfaces of the branch pieces 66*a*, 76*a* on one side are formed so that the surfaces thereof facing the recording heads are set closer to the recording heads than the other branch pieces 66*b*, 76*b*, that is, set higher than the latter according to this embodiment of the present invention.

Figure 8A:
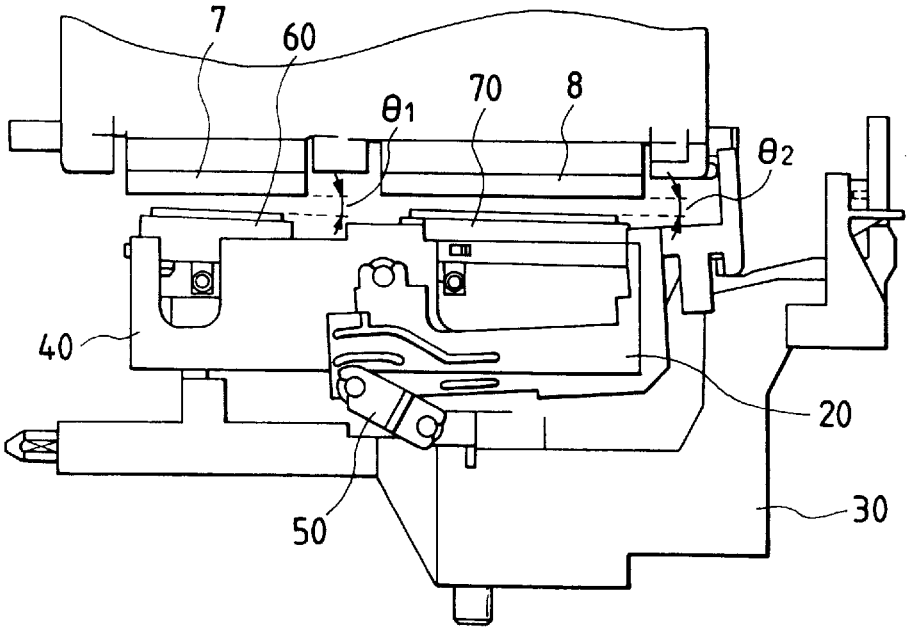
FIGS. 8(*a*) and 8(*b*) are diagrams showing the inclinations of the respective first and second caps in a direction perpendicular to the moving direction of them and in a direction parallel thereto with respect to a recording head at the time of non-capping.
Figure 8B:
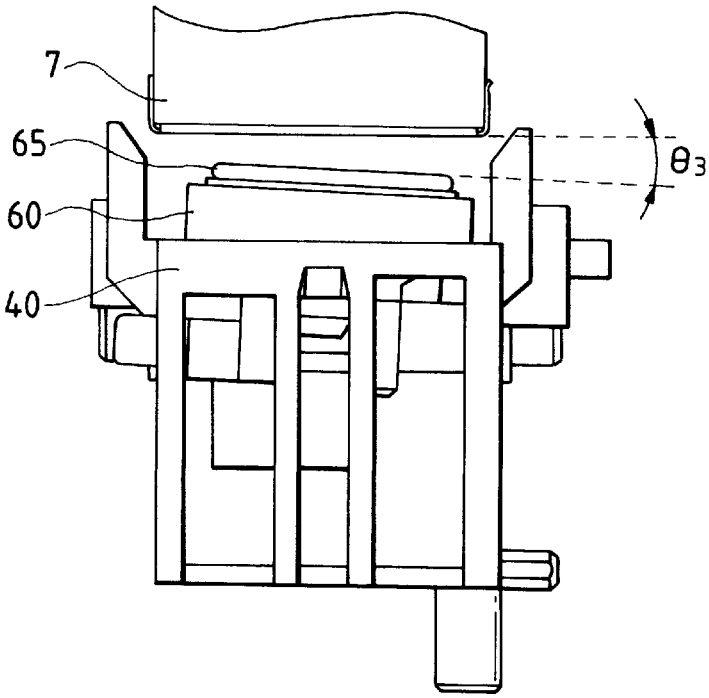

While the cap holders 60, 70 are being urged by the aforementioned springs 61, 62 and 71, 72 upward, they are accommodated in the cap holder receiving member 40 and held therein by pivotally engaging the upper ends of these slip stop portions 66, 67 and 76, 77 with the respective recesses of the cap holder receiving member 40. Thus, as shown in FIG. 8(*a*), the rear sides of the cap holders are slightly expansively opened by θ1, θ2 with respect to the recording heads 7, 8, and as shown in FIG. 8(*b*), the cap holders are accommodated in the cap holder receiving member 40 in such a state that one end side of each cap holder is expansively opened by an angle of θ3 in the width direction.

Figure 9A:
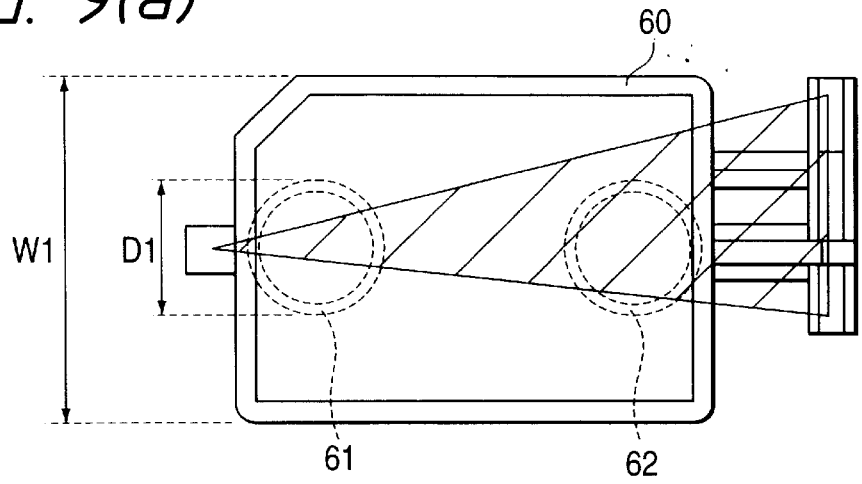
FIGS. 9(*a*) and 9(*b*) are diagrams showing contact positions of springs for suppressively supporting respective first and second cap holders, and FIG. 9(*c*) is sectional view showing a state in which the cap holder is supported by the spring.
Figure 9B:
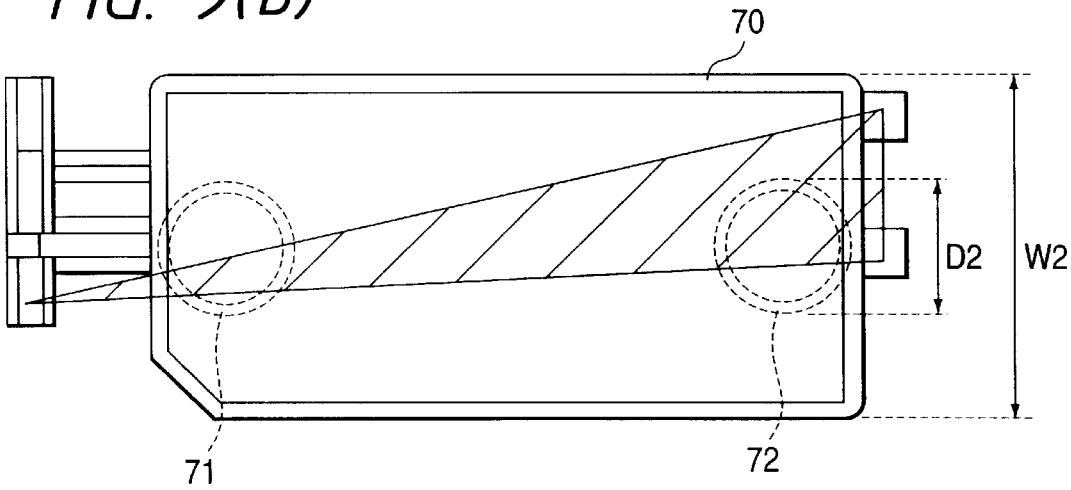
Figure 9C:
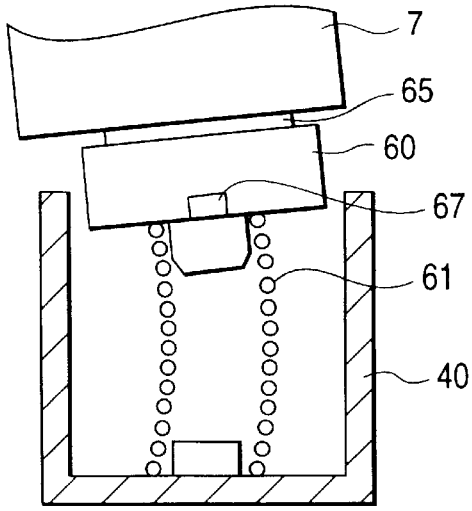

The springs 61, 62 and 71, 72 used to urge these cap holders 60, 70 are, as shown in FIGS. 9(*a*), 9(*b*), selected so that their external shapes Dl, D2 cover at least ⅓ of the width W1, W2 of the short sides of the cap holders 60, 70.

Consequently, to take an example from the cap holder 60, even if the slightly tilted cap holder is brought into contact with the recording head 7 as shown in FIG. 9(*c*), it maintains a posture in which it is capable of sealing up the recording head 7 by means of the spring 61 itself. As shown in FIGS. 9(*a*), 9(*b*), the springs 61, 62 and 71, 72 are arranged in that they are positioned on the respective end sides of the long sides of the cap holders 60, 70. Further, these springs 61, 62 and 71, 72 are preferably positioned inward from or across a triangular area (the area shown by hatching in FIGS. 9(*a*) and 9(*b*) connection points where the slip stop portions 66, 67 and 76, 77 are brought into contact with the cap holder receiving member 40.

Figure 10A:
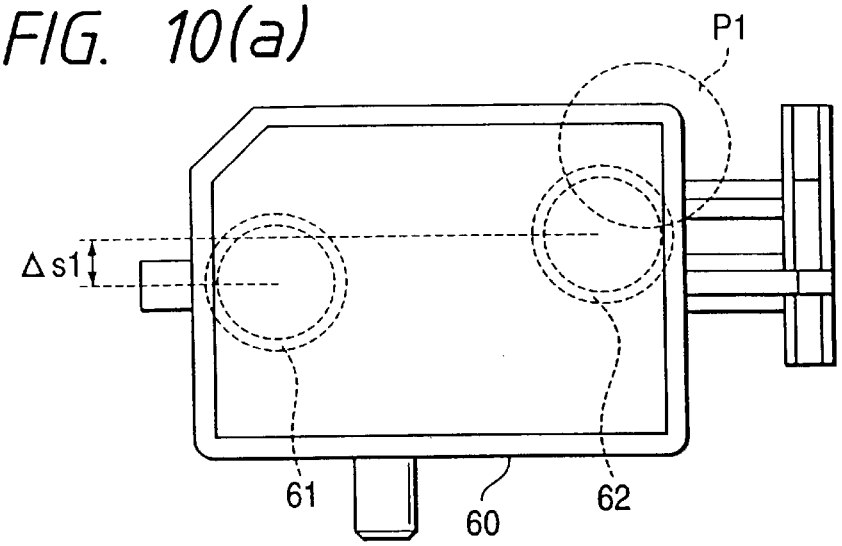
FIGS. 10(*a*) and 10(*b*) are diagrams showing contact positions of springs for suppressively supporting respective first and second cap holders according to another embodiment of the present invention.
Figure 10B:
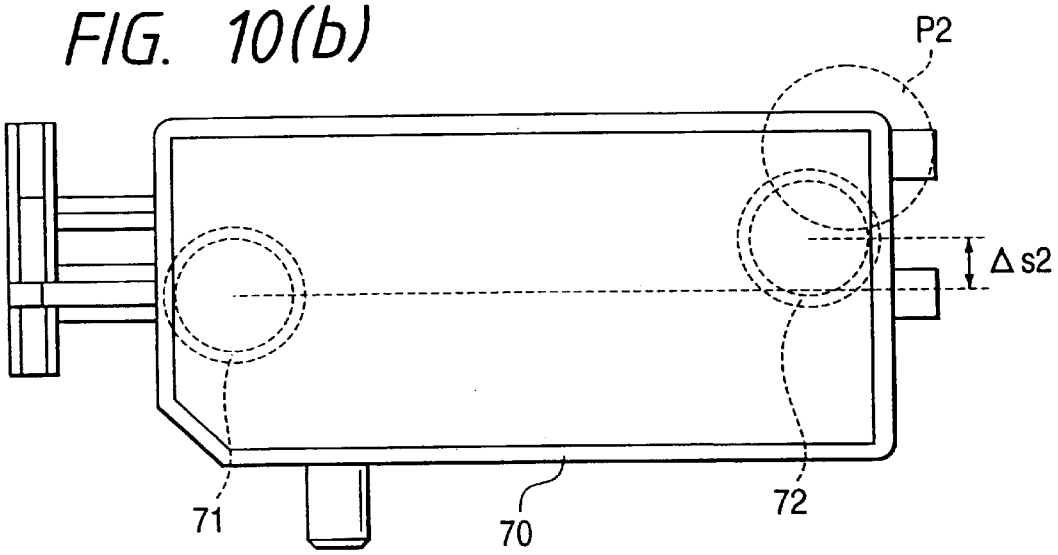
Figure 11:
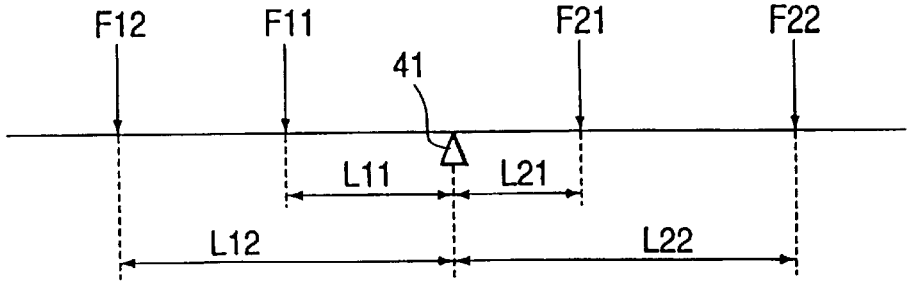
FIG. 11 is a diagram illustrating the moments of the springs for suppressively supporting the first and second cap holders.

Since one end sides of the caps 65, 75 are tilted by the angles θ1, θ2, θ3 with respect to the planes of the recording heads 7, 8 so that the one end sides thereof are expansively opened as described above, the balance of the force of bringing the caps 65, 75 contact with the recording heads 7, 8 is lacking, that is, the gaps with respect to the recording heads 7, 8 tend to become varied. Therefore, as shown in FIGS. 10(*a*), 10(*b*), the springs 62, 72 positioned in areas P1, P2 where the contact force is weakened are offset toward the areas P1, P2 by $^{\Delta}$S1, $^{\Delta}$S2 from the center line, and springs 62, 72 having greater resiliently pressing force are preferably employed. The force F11, F12 of the springs 61, 62 for resiliently pressing the cap holder 60 and the force F21, F22 of the springs 71, 72 for resiliently pressing the cap holder 70 are so selected as to make the moment M1=(F11×L11+F12×L12) and the moment M2=(F21×L21+F22×L22) acted on the shaft 41 substantially equal (FIG. 11).

Figure 12A:
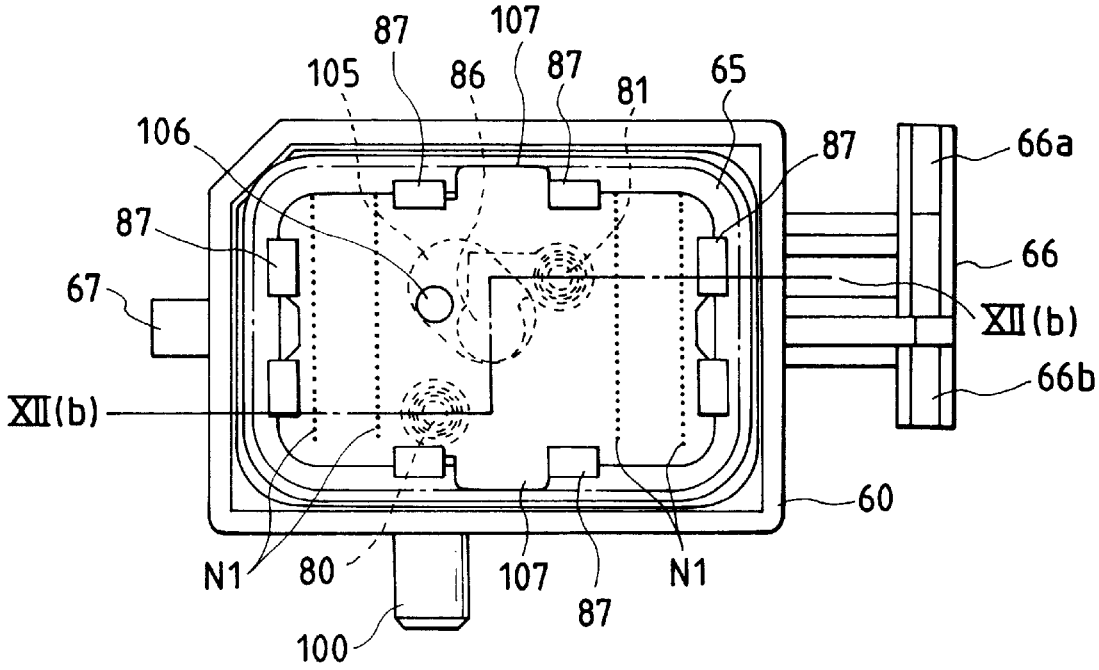
FIGS. 12(*a*) and 12(*b*) are diagrams showing the surface structure of the first cap and a sectional structure taken along a line XII(b)—XII(b), respectively.
Figure 12B:
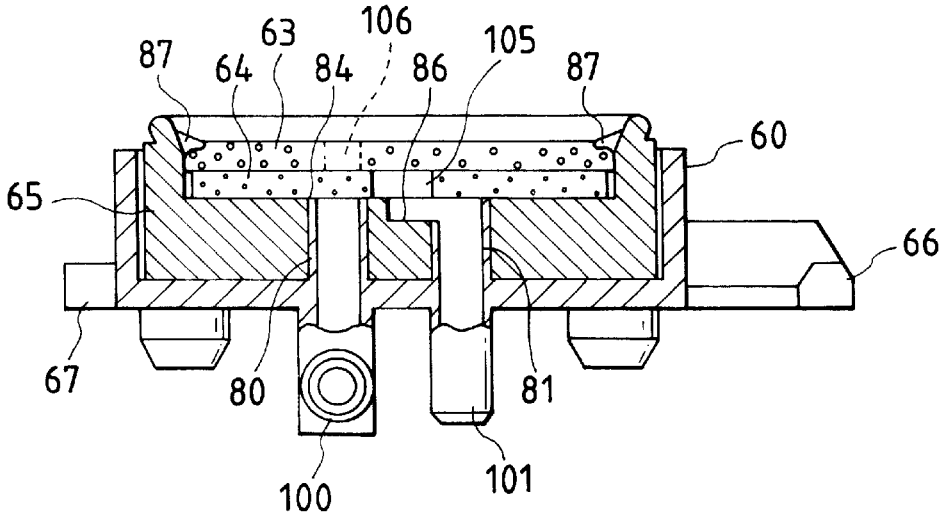
Figure 13A:
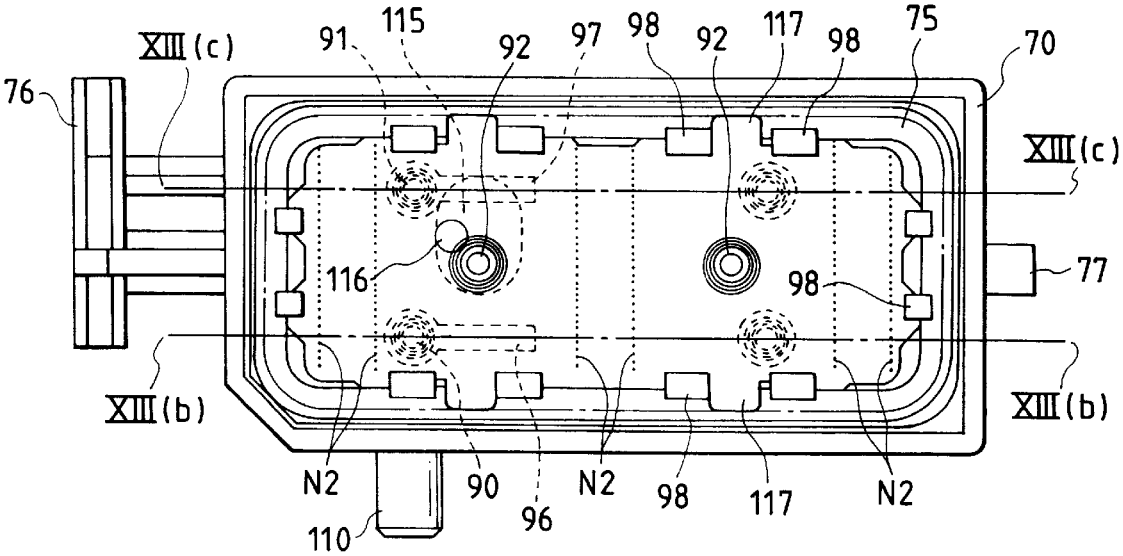
FIGS. 13(*a*), 13(*b*) and 13(*c*) diagrams showing the surface structure of the second cap, a sectional structure taken along a line XIII(b)—XIII(b) and what is taken along a line XIII(c)—XIII(c), respectively.
Figure 13B:
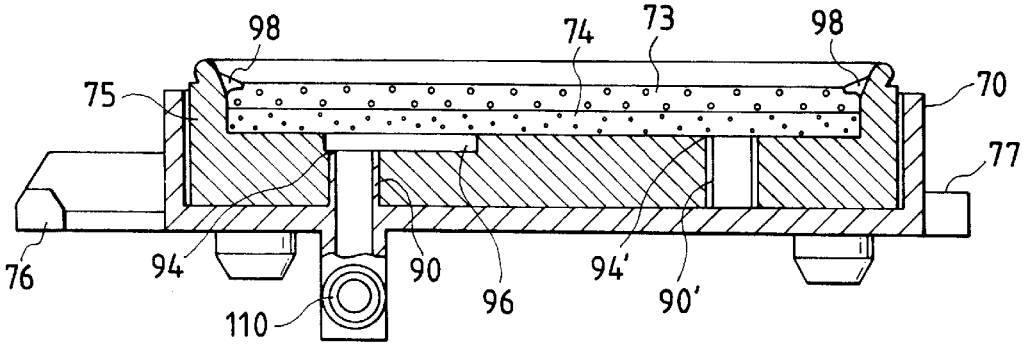
Figure 13C:
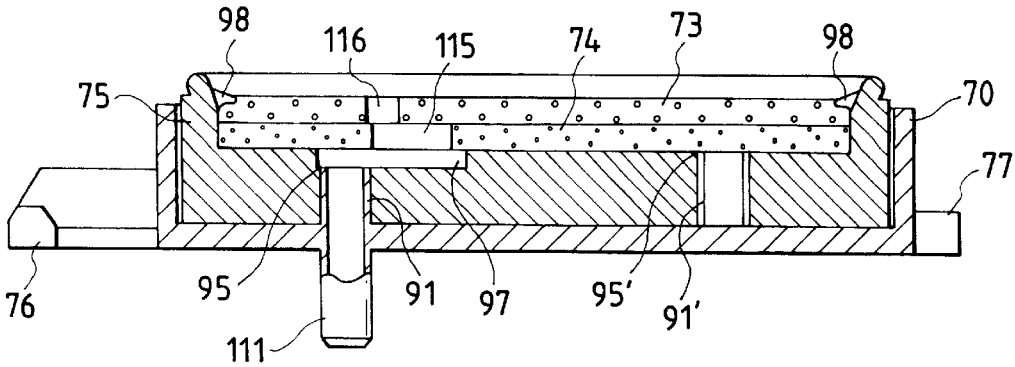

The first cap holder 60 has in its bottom portion the retaining member of the cap 65, the pump unit 14 and two cylindrical bodies 80, 81 simultaneously used as connection pipes with the valve seat 25. The cylindrical body 80 is, as shown in FIG. 12, used to connect a pump connection 100 integral therewith to the pump unit 14 via a tube 54, whereas the cylindrical body 81 is used to connect an air-communicating-port connection 100 to the opening 23 of the valve seat 25 via a tube 55. The cylindrical body 70 has in its bottom portion the retaining member of the cap 75, the pump unit 14 and two cylindrical bodies 90, 91 simultaneously used as connection pipes with the valve seat 25. The cylindrical body 90 is, as shown in FIG. 13, used to connect a pump connection 110 integral therewith to the pump unit 14 via a tube 56, whereas the cylindrical body 91 is used to connect an air-communicating-port connection 111 to the opening 24 of the valve seat 25 via a tube 57.

Figure 14A:
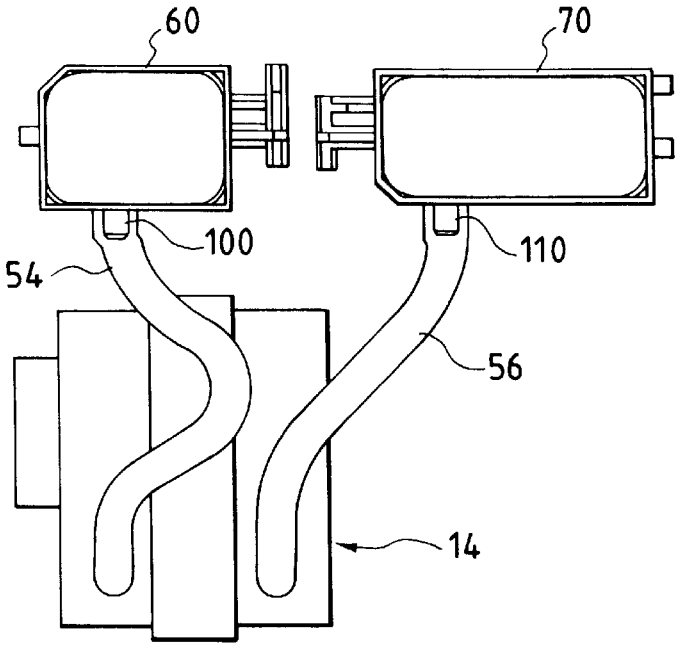
FIGS. 14(*a*) and 14(*b*) are top views showing forms of tubes for connecting a pump and a cap holder, respectively.
Figure 14B:
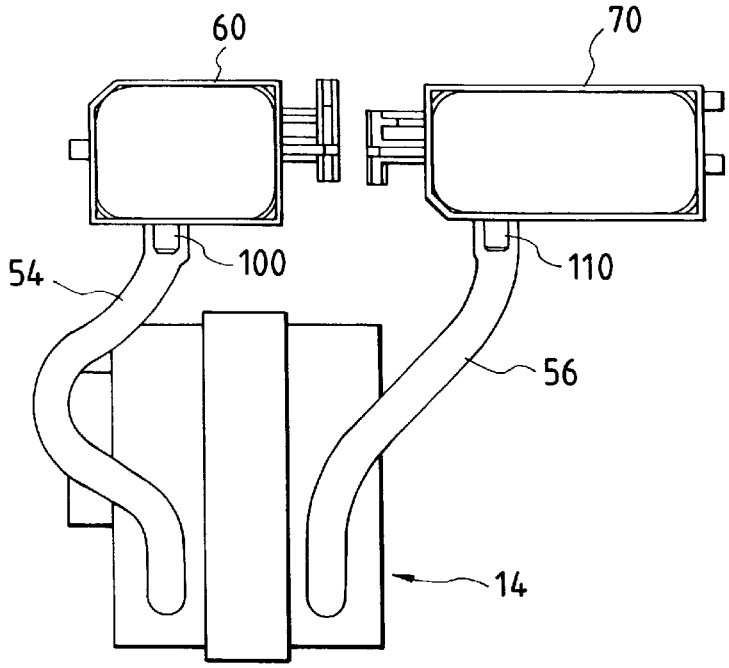
Figure 15:
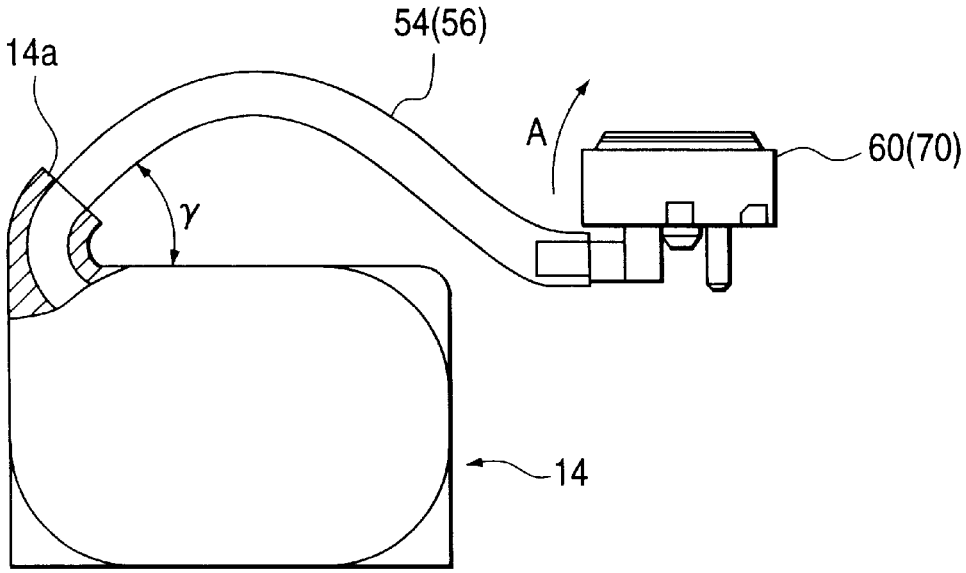
FIG. 15 is a side view explanatory of the form of drawing the tube from the pump unit and the force of the tube exerting on the cap holder.

FIG. 14 shows connecting relations between the pump unit 14 and the cap holders 60, 70, wherein the pump unit 14 is in a double strand of pump tubes according to this embodiment of the present invention, one ends of the tubes 54, 56 being drawn to suction port sides so as to form connection pipes. In view of the structure of the pump unit 14, the tubes 54, 56 are, as shown in FIG. 15, led out in such a manner that it remains parallel to a plane perpendicular to what include the moving direction of the carriage 1 via a guide 14*a*, and tilted by an angle τ. Further, the tube is made of relatively rigid material because it has to be placed in a limited space, functions as a pump tube and has also to resist against the pressure applied by a roller. Therefore, the great repulsive force of the tubes 54, 56 results in giving a moment to the cap holders 60, 70 in the direction of an arrow A of FIG. 15. This moment needless to say acts on the caps 65, 75 and the recording heads 7, 8 in such a way as to impair the adhesion therebetween.

Figure 16:
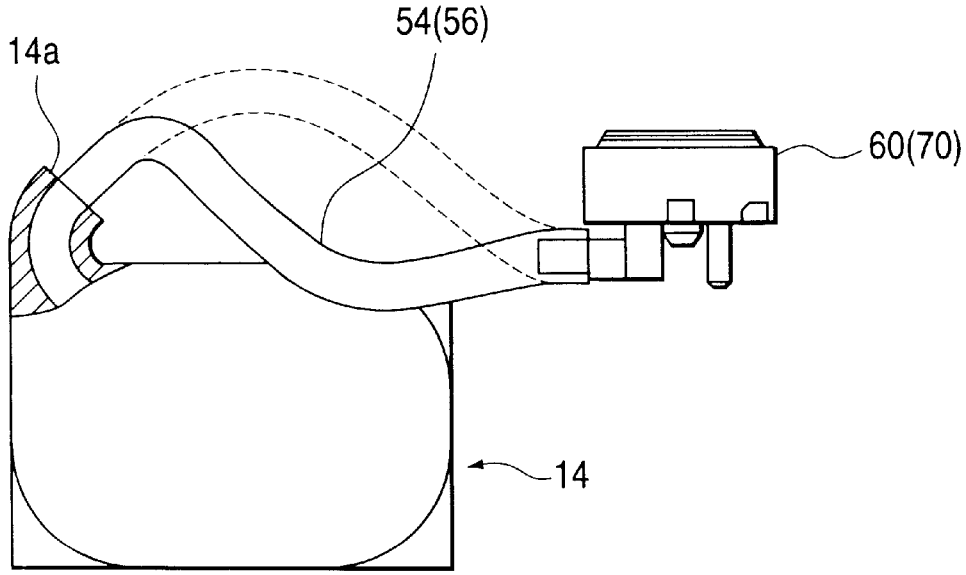
FIG. 16 is a side view showing the form of the tube for connecting the pump and the cap holder.

In order to ease this problem, the tubes 54, 56 are, as shown in FIG. 16, twisted so that they are so postured as to be parallel to a plane including the moving direction of the carriage 1 by means of their individual resiliency. The twisting of this sort is, as shown in FIG. 14(*a*), given in the same direction mutually or, as shown in FIG. 14(*b*), in directions opposite to each other. The tubes 54, 56 are thus forcibly directed to the horizontal direction in order to prevent the generation of a moment which impairs the adhesive force without impairing the motion of the slider 20 and to decrease the height of the whole apparatus.

Of the tubes connected to the valve 25, on the other hand, one end 55*a* of the tube 55 connected to the first cap holder 60 separated from the valve 25 is connected to a connection port 26*a* formed in a direction parallel to the moving direction of the slider 20 from the side wall of the holder 26; the body area 55*b* thereof is secured to the side of the slider 20; and the other end 55*c* thereof is fitted in the connection 101 of the cylindrical body 81 formed vertically on the bottom of the holder 60. One end of the tube 57 connected to the second holder 70 position near the valve 25 is connected to a connection port 26*b* formed in a direction perpendicular to the moving direction of the carriage 1 from the side wall of the holder 26; the tube 57 is curved in substantially parallel to a plane perpendicular to the moving direction of the slider 20 so as to form a curved portion 57*b*; and the other end 57*b* thereof is fitted in the connection 111 of the cylindrical body 91 formed vertically on the bottom of the holder 70.

Figure 17A:
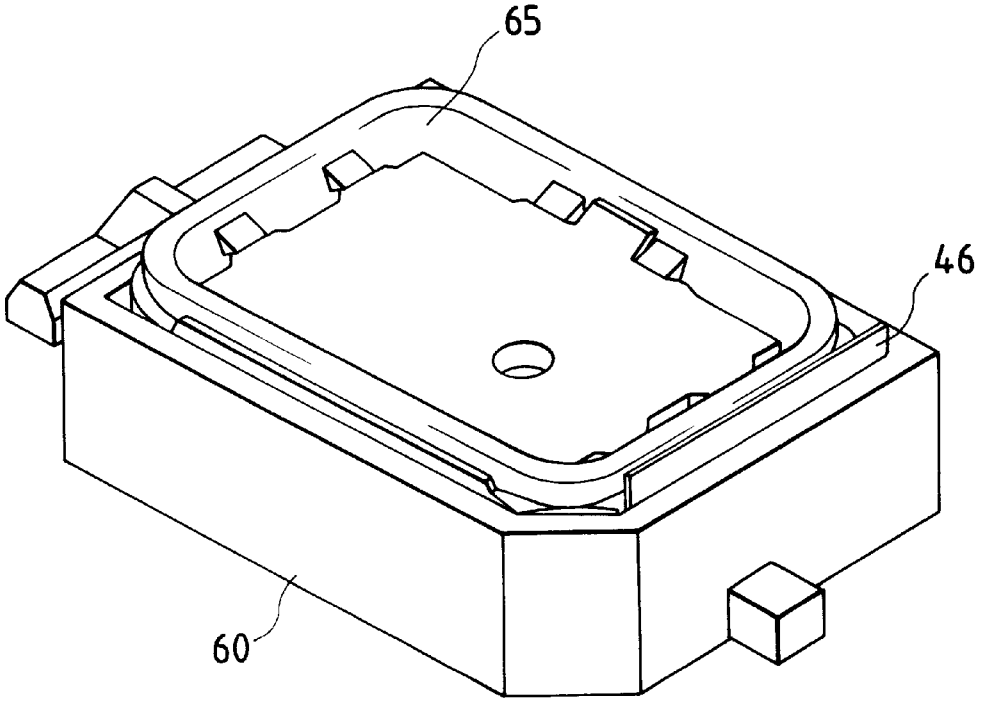
FIGS. 17(*a*) and 17(*b*) are a perspective view and an enlarged sectional view showing the cap and the cap holder which are placed on the wiper blade side, respectively.
Figure 17B:
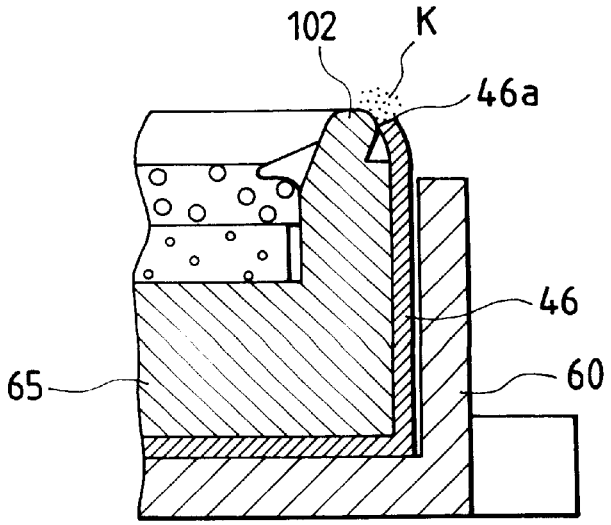

A plurality of pawls 68, 68 are formed on the inner peripheral face of the first cap holder 60. Further, recesses 69, 69 engaging with the pawl 68 are formed in the outer peripheral side face of the cap 65, and through-holes 84, 85 engaging with the aforementioned cylindrical bodies 80, 81 are formed in the bottom thereof, these engaging with one another to have the cap 65 held by the holder 60. The front of an ink absorbing plate 46 is, as shown in FIGS. 17(*a*), 17(*b*), disposed in contact with a thin-wall portion 102 for forming the sealing surface of the cap 65 on the opposite side of the wiping blade 15. The ink absorbing plate 46 is folded into the bottom of the holder 60 and clamped by the holder 60 and the cap 65.

A plurality of pawls 78, 78 are formed on the inner peripheral face of the cap holder 70. Further, recesses 79, 79 engaging with the pawl 78 are formed in the outer peripheral side face of the cap 75, and through-holes 94, 95 and 94', 95' engaging with the cylindrical bodies 90, 91 and dummy cylindrical bodies 90', 91' are formed in the bottom thereof, these mutually engaging with one another to have the cap 75 held by the holder 70. Further, the cap 75 is installed so that receiving portions 93, 93 for holding rivets for use in surely holding the ink absorbing sheets 73, 74 are formed in order that the rivets 92, 92 are fixed in a position not facing a nozzle opening orifice N2. Further, the dummy cylindrical bodies 90', 91' are formed in a position symmetrical with the cylindrical bodies 90, 91.

The thin-wall portion 102 of the cap 65 is formed whose rigidity is lower than that of any other portion in order for its open face to function as a sealing portion; thus, an ink repellent process is provided. Further, a plurality of pawls 87, 87 for retaining the surface of the upper-layer ink absorbing sheet 63 is formed closer to the bottom side from the thin-wall portion. A recess 86 communicating with the cylindrical body 81 is formed in the bottom.

The pawl 87 of the cap 65 and the pawl 98 of the cap 75 press down the ink absorbing sheets 63, 64 and the ink absorbing sheets 73, 74 against their resiliency toward the bottom side in order to prevent them from floating up whereby to earn the distance between the recording heads 7, 8 and the ink absorbing sheets 63, 73 by decreasing the depth of the caps 65, 75 as much as possible. While an attempt is made to make compact the caps 65, 75, the ink forced to be discharged from the recording heads 7, 8 can thus be prevented from splashing back to the recording heads 7, 8.

Figure 18A:
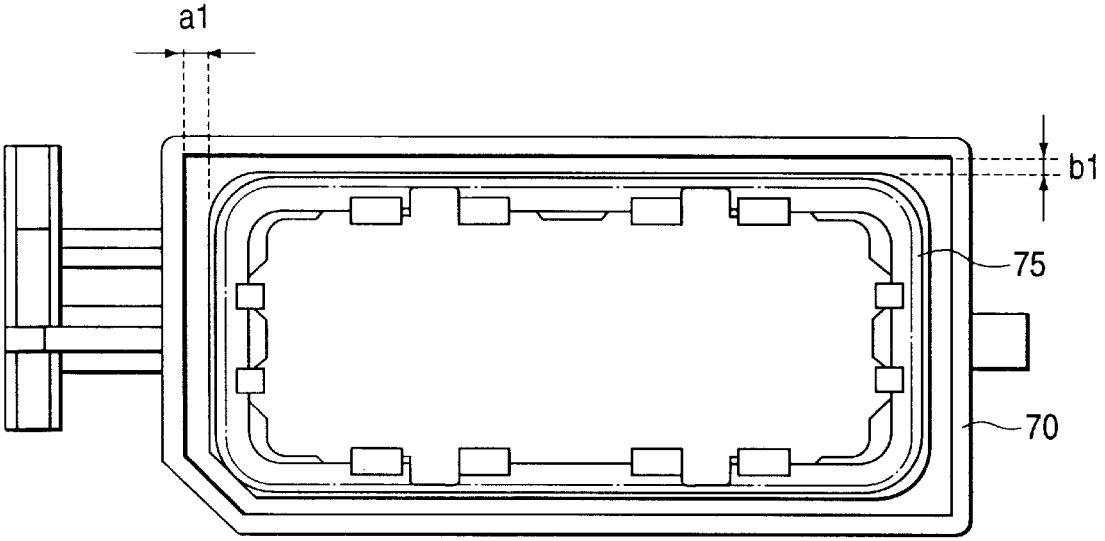
FIGS. 18(*a*), 18(*b*) and 18(*c*) are diagrams showing the gap formed between the cap holder and the cap, and the function of the gap, respectively.
Figure 18B:
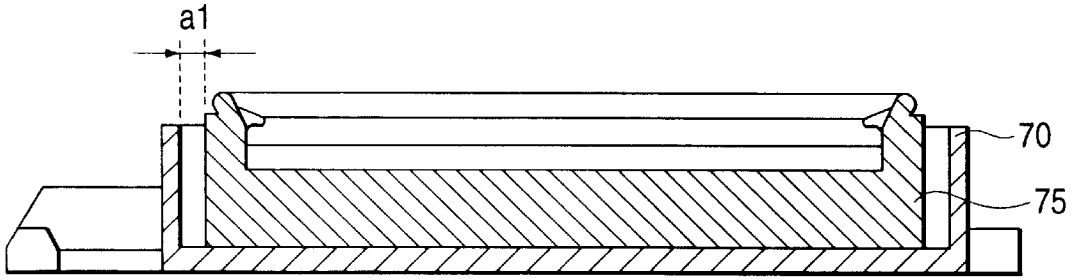
Figure 18C:
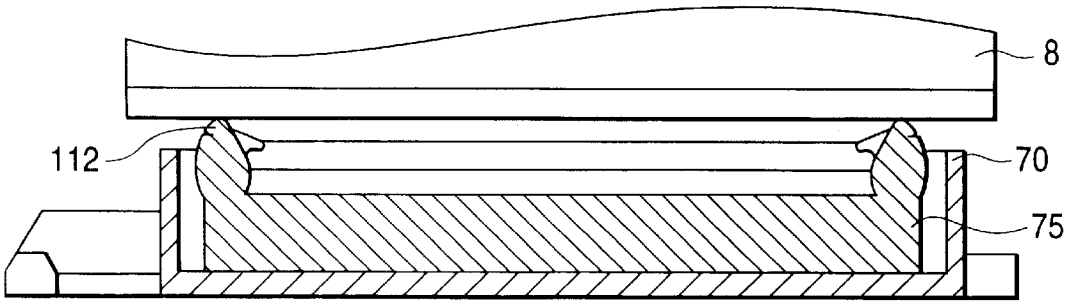
Figure 19A:
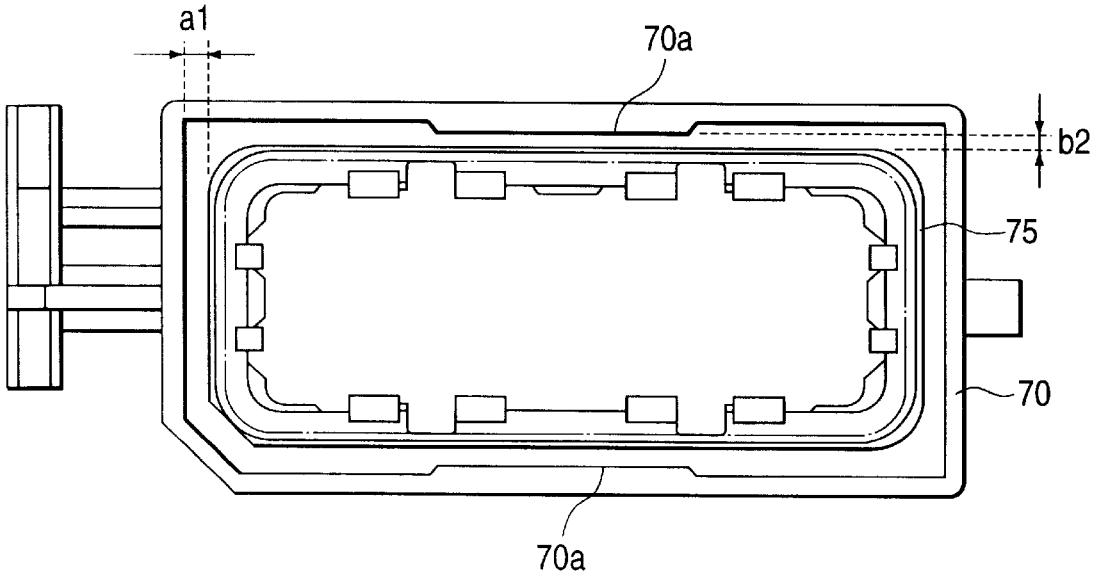
FIGS. 19(*a*) and 19(*b*) are top views showing a cap holder according to another embodiment of the present invention, respectively.
Figure 19B:
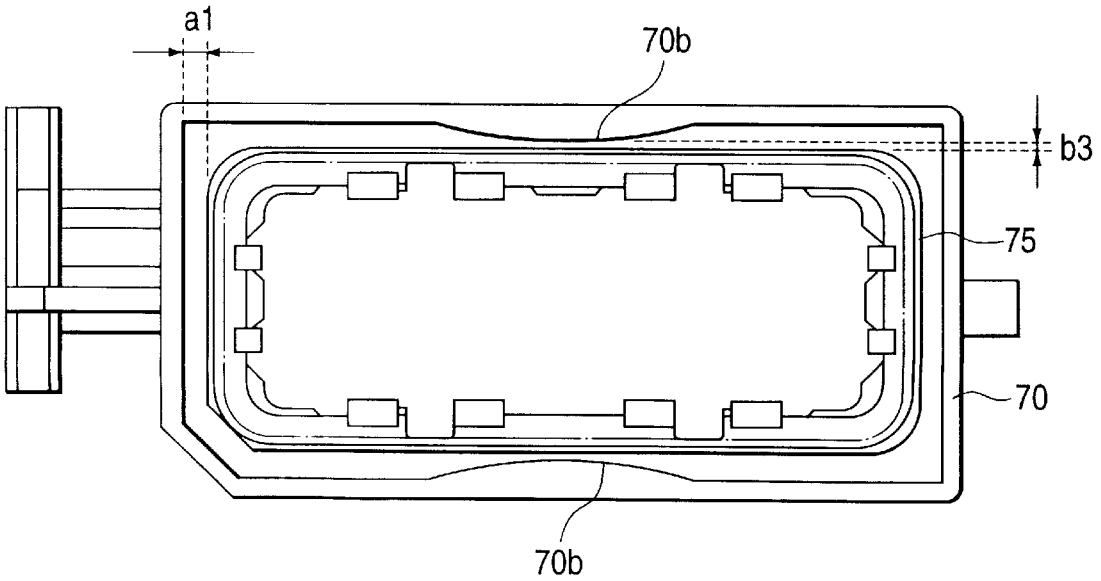

To take an example from the second cap holder 70 representing both the first and second cap holders 60, 70, gaps a1, b1 wide enough to maintain the sealing condition and to absorb the expansion of the cap 75 are formed with respect to the cap 70 as shown in FIGS. 18(*a*), 18(*b*). The gap bl on the long side which is comparatively less rigid is set smaller than the gap a1 on the short side. The gap b1 on the long side is, as shown in FIGS. 19(*a*), preferably formed with wide protrusions 70*a*, 70*a* protruding toward the cap side in the central area of the cap holder receiving member 70 or convex portions 70*b*, 70*b* as shown in FIGS. 19(*b*) in order to uniformize the rigidity of the thin-wall portion 112 of the whole cap 70 by suppressing the gaps b2, b3, which readily tend to bend, in the central area of the long side. Further, the protrusion 70*a* and the convex portion 70*b* for regulating the gap has obviously the same effect even though they are formed on the outer peripheral side of the cap 75. By securing a proper gap of 0.2–1.0 mm, preferably a gap of about 0.4 mm in a case where rubber hardness ranges from 50 to 60° between the holders 60, 70 and the caps 65, 75, it is possible to provide resiliency for the caps 65, 75 in order to secure their sealing properties while allowing them to have rigidity to such an extent that the precision of their configuration can be maintained.

Further, by securing a certain degree of rigidity and resiliency for the caps 65, 75, the caps 65, 75 are prevented from slipping off the holder 60, 70 even though the caps 65, 75 are stuck to the surface of the recording heads 7, 8 due to dried ink as the caps are brought into resilient contact with the holders 60, 70 due to distortion resulting from some amount of elastic deformation while the acting force applied when the caps 65, 75 are opened is absorbed by the resiliency of the caps 65, 75.

Figure 20:
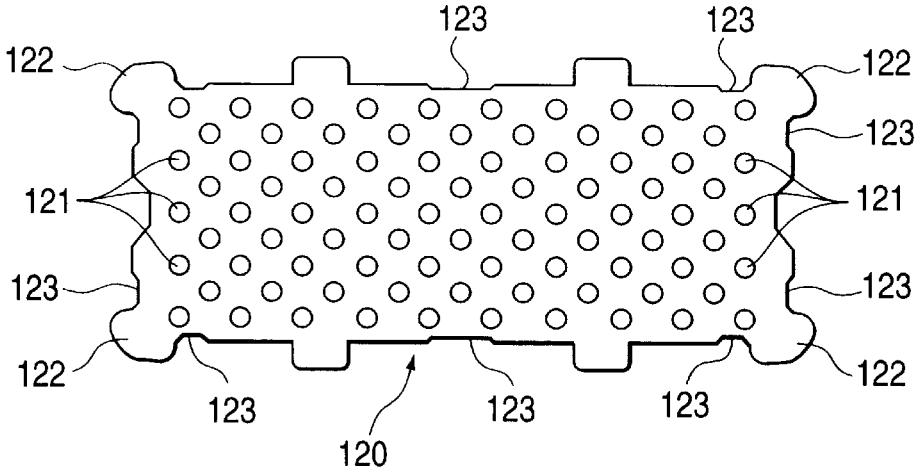
FIG. 20 is a diagram showing an ink absorbing sheet to be placed in the upper layer of a cap according to another embodiment of the present invention.

The ink absorbing sheets 63, 64 and 73, 74 accommodated in the respective caps 65, 75 are provided with measures to prevent the ink absorbing sheets from stripping off because of swelling by providing a small number of relatively large through-holes 103, 104 and 113, 114 in a position where the common ink absorbing function is not specifically impaired, uniformly forming a number of very small through-holes 121 over the whole sheet as shown in FIG. 20, or providing cutouts in the corner portion to which the swelled volume is shifted so as to make the through-holes 103, 104, 113, 114, 121 or the cutouts 123, 123 absorb what is equivalent to the swelled volume.

A relatively large through-hole 105 communicating with the recess 86 of the cap 65 is bored in the ink absorbing sheet 64 accommodated in the lower layer of the cap 65, whereas a relatively small through-hole 106 is bored in the ink absorbing sheet 63 accommodated in the upper layer thereof in such a position that the through-hole 106 is not made opposite to the through-hole 85. Further, these through-holes 105, 106 are, as shown FIG. 12(*a*), positioned in the central portion where intervals of a nozzle opening orifice N1 are relatively large so that the through-holes do not face the nozzle opening orifice N1 and that a line connecting the nozzle opening orifice N1 and the open portion of the cylindrical body 80 does not cross the nozzle opening orifice N1.

Figure 21A:
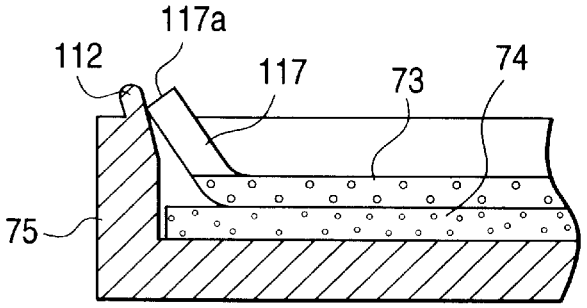
FIG. 21(*a*) is a diagram showing the relation between the tongue piece of the ink absorbing sheet and the thin-wall portion of the cap.
Figure 21B:
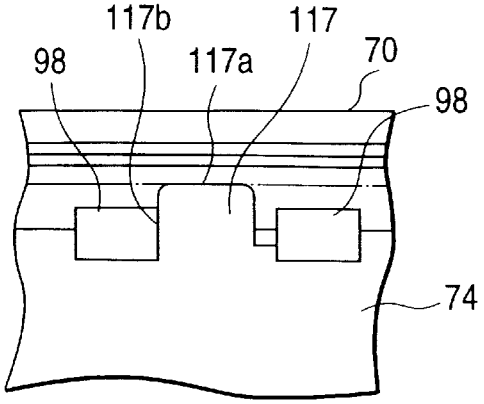
Figure 21C:
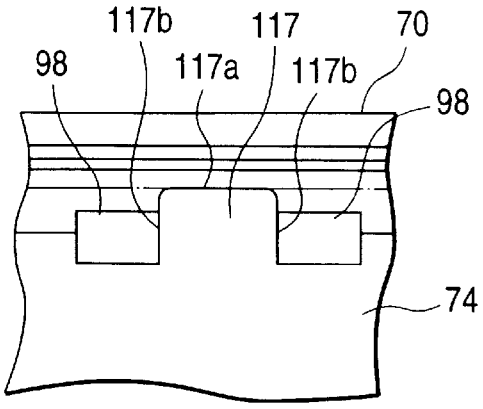
Figure 22A:
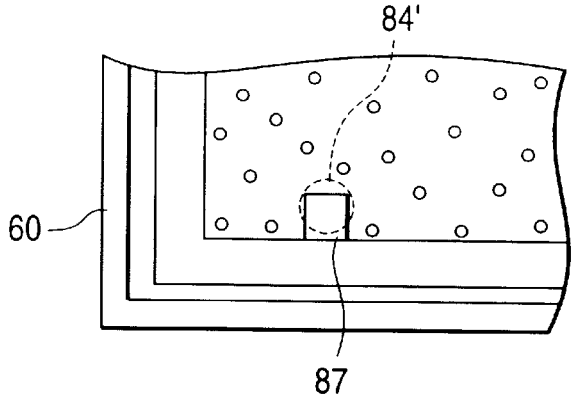
FIGS. 22(*a*) and 22(*b*) are diagrams illustrating nonconformity arising from the positional relation between a through-hole communicating with the pump unit and the ink absorbing sheet.
Figure 22B:
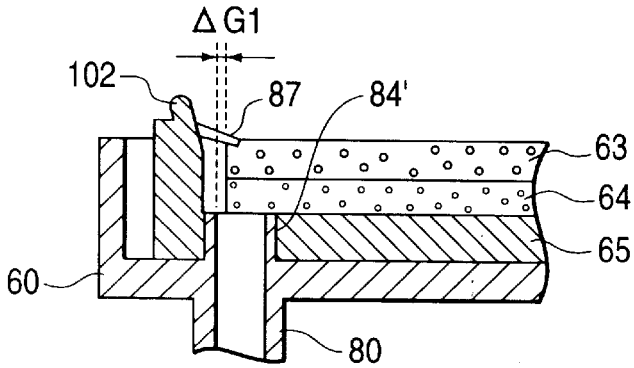
Figure 22C:
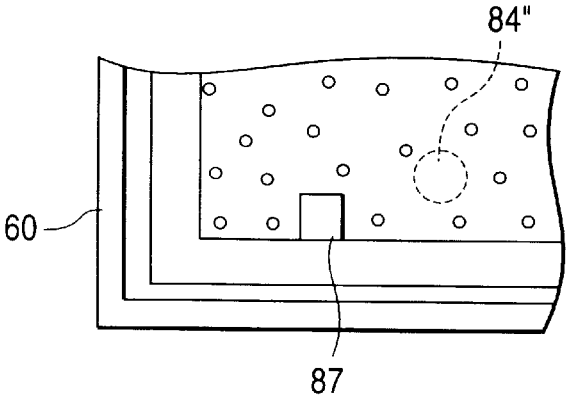
Figure 22D:
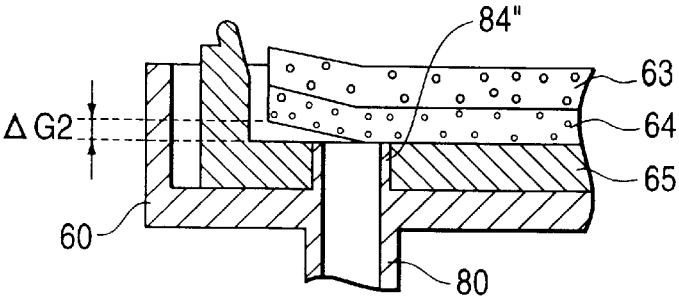

Of the plurality of ink absorbing sheets accommodated in the caps 65, 75, further, the ink absorbing sheets 63, 73 disposed in the uppermost layers are formed with tongue pieces 107, 107, . . . and 117, 117, 117, 117, . . . To take an example from the ink absorbing sheet 73, the front end 117*a* is, as shown in FIG. 21(*a*), brought into contact with the proximity of the lower portion of the thin-wall portion 112 of the cap 75, and the side face 117*b* of the tongue piece 117 is, as shown in FIG. 21(*b*), brought into contact with the side face of the pawl 98 of the cap 75. To take an example from the ink absorbing sheet 73, both side faces 117*b* of the tongue piece 117 . . . are, as shown in FIG. 21(*c*), brought into resilient contact with the respective two pawls 98, 98 positioned on both sides beforehand or preferably brought into resilient contact with the respective two pawls 98, 98 positioned on both sides in a swelled condition at least after the tongue piece has absorbed ink. Preferably, tongue pieces 122, 122, 122, . . . are, as shown in FIG. 20, formed opposite to one another at the respective four corners of the caps 60, 70, so that the tongue piece 122 is desirably used to guide ink which tends to accumulate at the corners of the thin-wall portions 102, 112 of the caps 60, 70. Further, it is desired to form these tongue pieces 107, 117, 122 in positions not opposite to the nozzle opening orifices N1, N2 at the time of flushing and capping the recording heads 7, 8.

In order to ensure that negative pressure from the pump unit 14 is made to act on the ink absorbing sheets 63, 64 and 73, 74 accommodated in the respective caps 65, 75, the positions of the through-holes 84, 94 communicating with the pump unit 14 and the pawls 87, 98 in the proximity thereof are restricted to a certain degree. In other words, to take an example from the cap 65, even though the ink absorbing sheets 63, 64 are, as shown in FIGS. 22(*a*), 22(*b*), made to adhere to the bottom portion of the cap 65 when a through-hole 84' communicating with the pump unit 14 is formed near the side wall of the cap 65, there is produced a gap $^{\Delta}$G1 as the whole through-hole 84' is not covered with the pump unit 14 and idle suction is caused. When a through-hole 84" communicating with the pump unit 14 is formed in a position set away from the wall of the cap 65 or the pawl 87 as shown in FIGS., 22(*c*), 22(*d*), on the contrary, there is produced a gap $^{\Delta}$G2 between the through-hole 84" and the ink absorbing sheets 63, 64 because of the floating-up of the ink absorbing sheets 63, 64 resulting from swelling and the like, and such idle suction is also caused. Therefore, at least the through-holes 84, 94 communicating with the pump unit 14 are preferably formed in the proximity of the pawls 87, 98 of the caps 65, 75 and separated by at least about the diameters of the through-holes 84, 94 from the respective walls of the caps.

A description will subsequently be given of the apparatus thus constructed.

Figure 23:
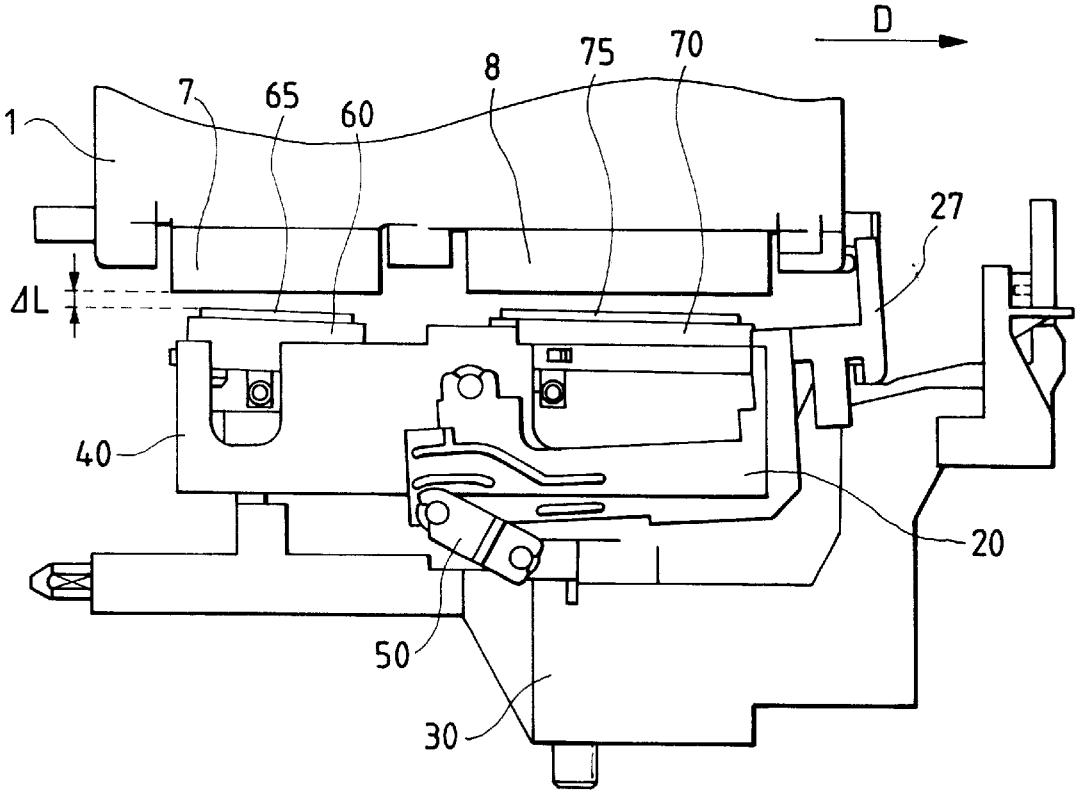
FIG. 23 is a diagram showing a state in which the recording head has been moved to a flushing position.

While the slider 20 is unmoved even when the carriage 1 is, as shown in FIG. 23, moved in the non-printing direction (the direction shown by an arrow D therein) and brought into contact with the flag piece 27 of the slider 20, the first and second caps 65, 75 are placed opposite to the respective recording heads 7, 8 to be sealed up thereby with a fixed gap $^{\Delta}$L set therebetween. Consequently, ink drops are discharged from the nozzle opening orifices N1, N2, irrespective of print data, to have ink drop discharging capability recovered by supplying a drive signal to the recording heads 7, 8 in that condition. Then the ink drops are absorbed by the upper-layer ink absorbing sheets 63, 73 of the respective caps 65, 75 without splashing ink onto the recording heads 7, 8.

Figure 24I:
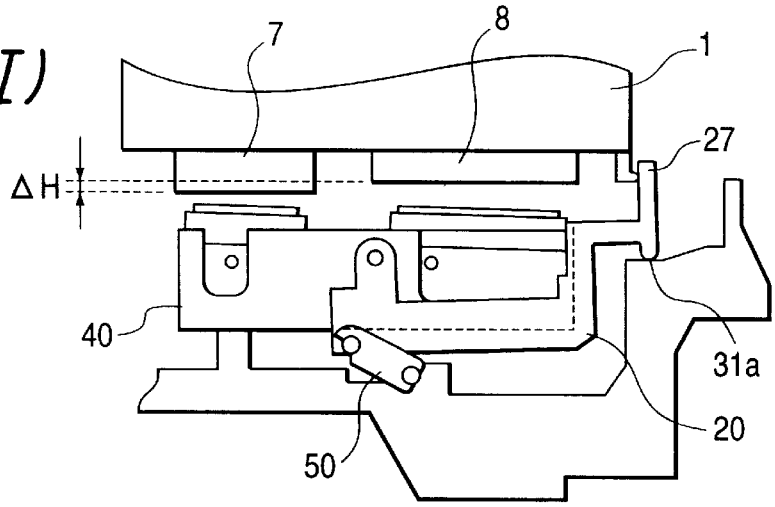
FIGS. 24(I)–24(III) are diagrams showing the motion of the cap holders, respectively.
Figure 24:
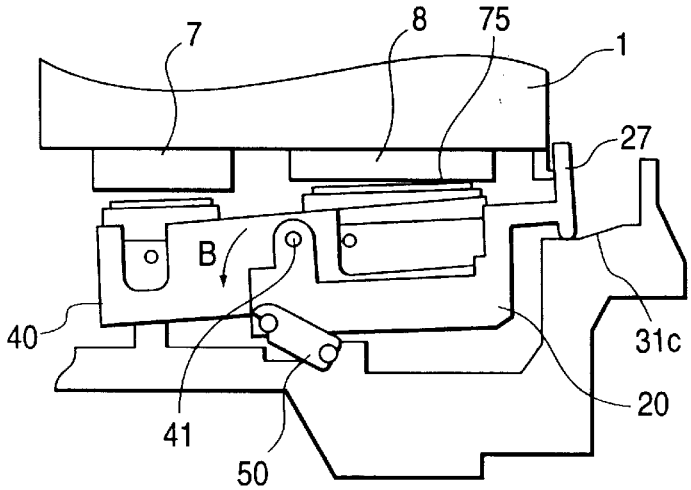

When the carriage 1 is moved to the rear end side (to the right in the drawing) further (FIG. 24(II)), the slider 20 is caused to move in the oblique direction while rotating the arm 50 against the tensile strength of the tension spring 51. Simultaneously, the cap holder receiving member 40 rotates in the direction of an arrow B in the drawing around the shaft 41 whose central portion is supported by the slider 20, whereby the cap 75 is brought into contact with the recording head 8 (FIG. 24 (II)). When the carriage 1 is moved further, since the contact piece 42 is guided to the slope portion 32*c* of the base, the front end side of the cap holder receiving member 40 is reversed in the direction of an arrow C in FIG. 24(II) so as to correct its posture to what is substantially parallel to the recording heads 7, 8 and move together with the slider 20 toward the recording head side. The cap holder receiving member 40 is then positioned in parallel to the recording heads 7, 8 by the high place portions 31*b*, 32*b* of the first and second guide surfaces 31, 32 to ensure that the recording heads 7, 8 are sealed up by the caps 65, 75 even though there exists a slight difference $^{\Delta}$H in level between the surfaces of the two recording heads 7, 8 (FIG. 24(III)).

Figure 25A:
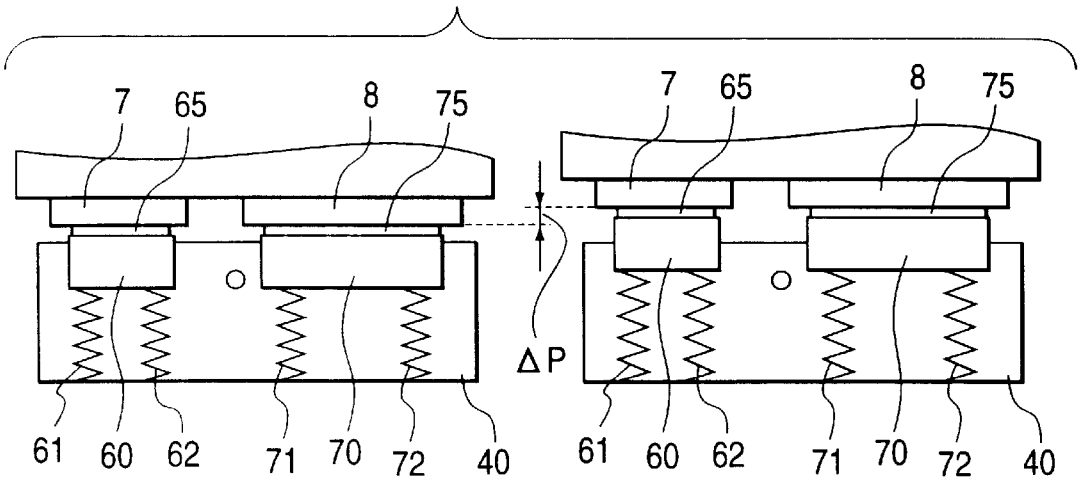
Figure 25B:
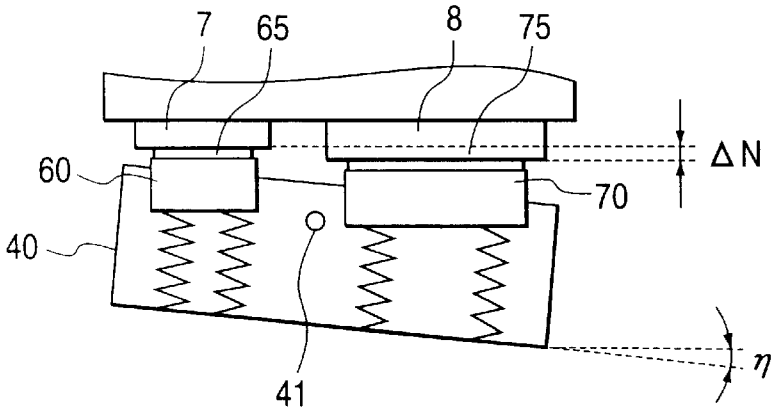

The cap holder receiving member 40 is thus positioned in parallel to the planes of the recording heads 7, 8 to ensure that the recording heads 7, 8 are sealed up when a variable component $^{\Delta}$P occurs in the platen gap in accordance with the thickness of recording paper as shown in FIG. 25(*a*), that is, even when the recording heads 7, 8 are displaced relatively to the caps 65, 75. When a gap $^{\Delta}$N is produced in the sealing surface between the recording heads 7, 8 due to variations in the fitting precision of the two recording heads 7, 8 to the carriage 1, the cap holder receiving member 40 is rotated by an angle of η so that the counter force received from the recording heads 7, 8 on both sides of the shaft 41 this time is balanced as shown in FIG. 25*b*, whereby the spring force of the springs 61, 62 and 71, 72 used to press the caps 65, 75 is uniformized to ensure that the recording heads 7, 8 are sealed up by the caps 65, 75 as an error in fitting the recording heads 7, 8 is absorbed.

Although the posture of the cap holder receiving member 40 is adjusted to become parallel to the planes of the recording heads 7, 8 before the caps 65, 75 are brought into contact with the recording heads 7, 8 according to this embodiment of the present invention, it is possible to reduce the load of the slider 20 by letting the cap holder receiving member 40 positively assume a non-parallel posture, that is, bringing the cap holder receiving member 40 into contact with one of the recording heads 7, 8 in a tilted condition by making the heights of the high place portions 31*b*, 32*b* of the slopes of the first and second guide surfaces 31, 32 different from each other. Even in this case, the cap holder receiving member 40 is made to rotate with respect to the slider 20 in order to bring ultimately the caps 65, 75 into resilient contact with the recording heads 7, 8. Further, the caps 65, 75 urged upward by the springs 61, 62 and 71, 72 respectively arrange in front and in the rear side immediately before they are brought into contact with the recording heads 7, 8 are, as shown in FIG. 8, slightly tilted with the rear end side as the lower side and one end side in the width direction as the lower side, whereby shock at the time of capping is eased since the thin wall portions 102, 112 are brought into contact with the recording heads 7, 8 while gradually increasing their contact areas from the one ends of their front end sides.

Figure 26:
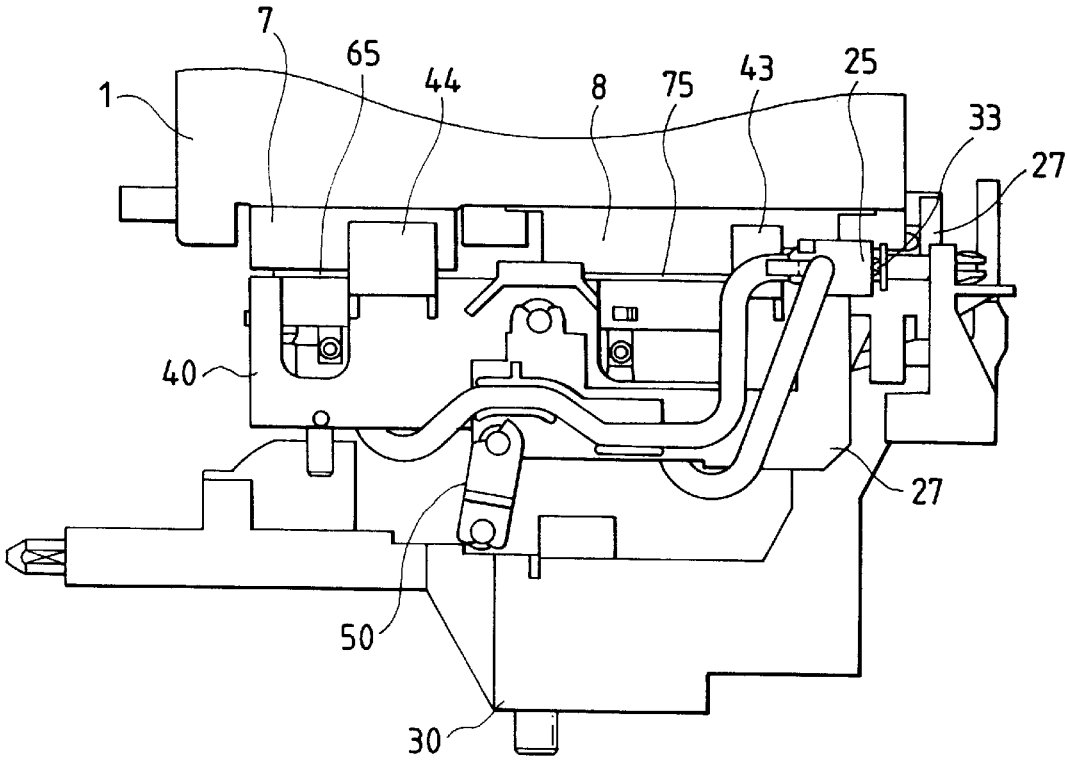
FIGS. 26(*a*) and 25(*b*) are diagrams illustrating the capping operation accompanied by the alteration of the platen gap and what corresponds to the fitting tolerance of the recording head, respectively.

In this stage wherein the caps 65, 75 are completely sealed up, the valve seat 25 is, as shown in FIG. 26, brought into resilient contact with the valve 33 installed on the base 30, and the caps 65, 75 are caused to cut off communication with the air and put in an airtight condition. Thus, the evaporation ink from the nozzle opening orifices N1, N2 is suppressed with the effect of preventing the nozzle from being clogged with ink. Since the tubes 54, 56 having relatively high rigidity as described above are made to have the habit of paralleling a plane including the moving directions of the recording heads 7, 8, the force of peeling the caps 65, 75 off the recording heads 7, 8 does not act on the caps 65, 75. Since the tubes 55, 57 connected to the valve seat 25 are vertically connected to the cap holders 60, 70, further, the force of peeling the caps 65, 75 off the recording heads 7, 8 does not also act on the caps 65, 75. Moreover, the force deriving from the tubes 54, 56 in the horizontal direction is received by the cap holder receiving member 40 and the sealing-up strength is not impeded accordingly.

When the nozzle opening orifices N1, N2 of the recording heads 7, 8 are clogged or when ink is forced out of the recording heads 7, 8 because of replacement of cartridges, on the other hand, the pump unit 14 is operated in the above-described capping state. The negative pressure from the pump unit 14 caused negative pressure to act on the insides of the caps 65, 75 via the holes 84, 94 of the caps 65, 75, whereby ink is sucked out of the nozzle opening orifices N1, N2. Thus, dust and fine powder sticking to the proximity of the nozzle opening orifices N1, N2 are cleaned and bubbles in the recording heads 7, 8 together with ink are discharged into the caps 65, 75.

The ink discharged from the recording heads 7, 8 is absorbed by the upper-layer ink absorbing sheets 63, 73 before being absorbed by the lower-layer ink absorbing sheets 64, 74 having finer pores by capillary force. Thus, the absorbing power is made improvable by decreasing the impregnated ink quantity in the upper-layer ink absorbing sheets 63, 73 as much as possible; ink is prevented from sticking to the recording heads 7, 8; and the splashing of ink is reduced when ink is forced to be discharged. When ink is thus forced to be discharged, the ink tends to accumulate in the proximity of the thin-wall portions 102, 112 of the caps 65, 75 and at the pawls 87, 98 due to the splashing and spattering of ink from the ink absorbing sheets 63, 73. However, the ink never stays at such spots as these spots are kept in contact with the tongue pieces 107, 117 used to absorb the ink, whereby the ink is prevented from uselessly sticking to the nozzle plates of the recording heads.

Figure 32A:
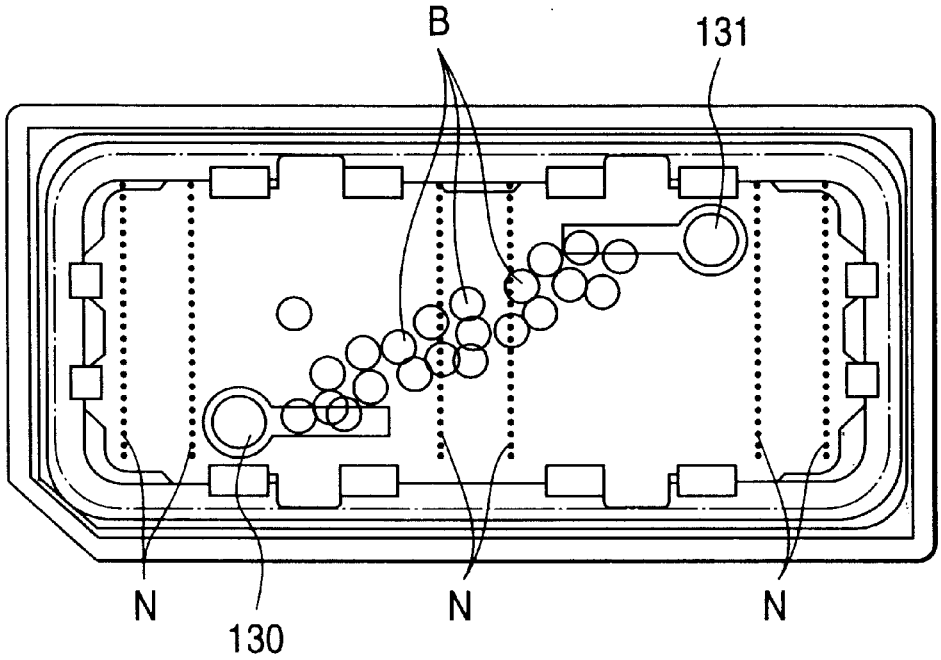
FIG. 32(a) PRIOR ART
FIGS. 32(*a*) and 32(*b*) are diagrams showing the ink bubbles produced by the ink absorbing sheets in the conventional cap, respectively.
Figure 32B:
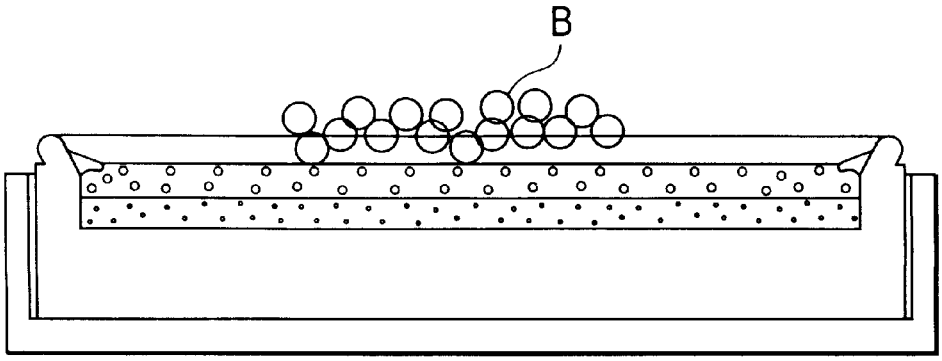
FIG. 32(b) PRIOR ART

As shown in FIG. 32, on the other hand, the provision of a suction port 130 and an air-communicating port 131 across a nozzle opening orifice N allows ink bubbles B, B, . . . generated when the air is introduced to cross the nozzle opening orifice N and the meniscus of the nozzle opening orifice N is destroyed. Further, the pawls 87, 98 for resiliently pressing the upper ink absorbing sheets 63, 73 positioned in the proximity of the cylindrical bodies 80, 90 at least communicating with the pump unit 14 are formed in the caps 65, 75 in which the ink absorbing sheets 73, 74 are accommodated. Moreover, the through-holes 84, 94 are also covered with the ink absorbing sheets 63, 64 and 73, 74 to ensure that ink is sucked without idle suction.

Figure 27:
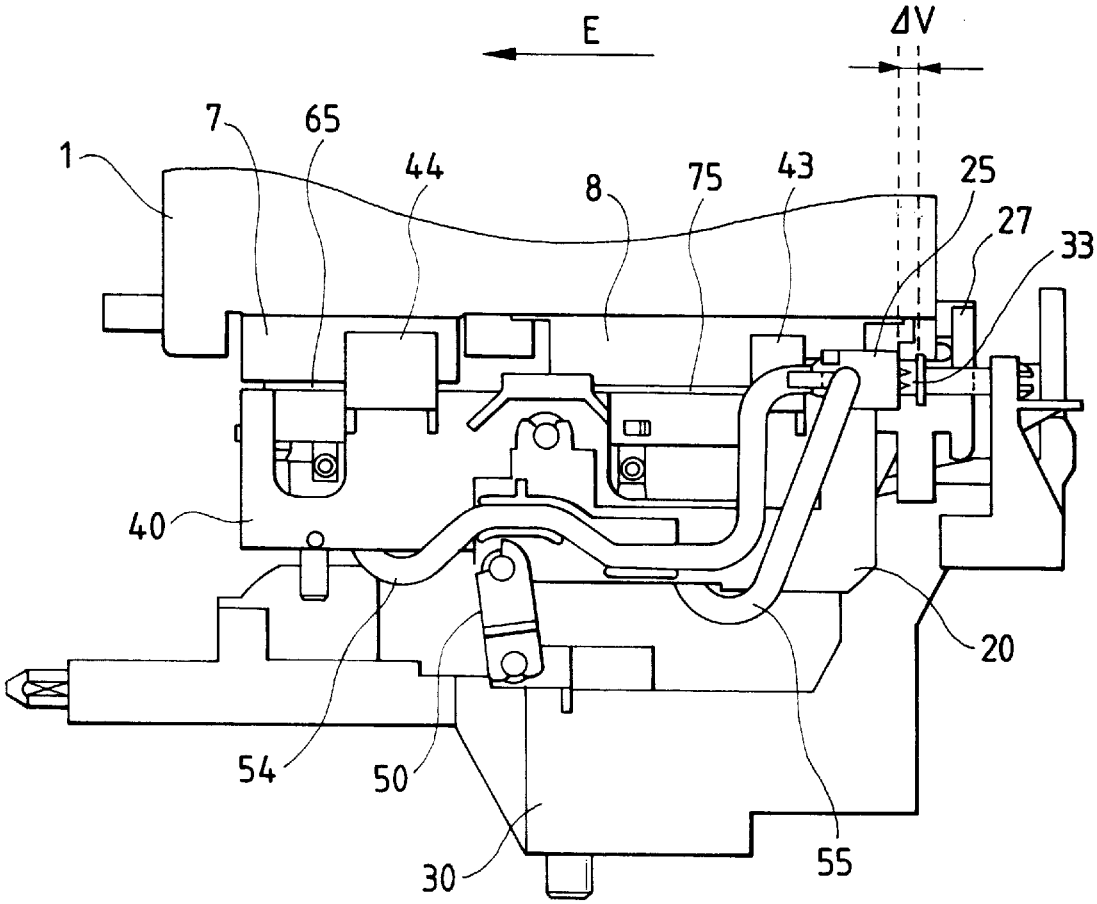
FIG. 27 is a diagram showing a state in which the recording head has moved from the capping unit to a position where ink is jetted.

When the operation of forcing ink to be discharged from the recording heads 7, 8 is completed, the carriage 1 is, as shown in FIG. 27, moved by a small amount $^{\Delta}$V in the front end direction (in the direction of an arrow E in the drawing) in order to make the through-holes 85, 95 of the caps 65, 75 communicate with the air by separating the valve seat 25 from the valve 33. When the pump unit 14 is subsequently operated, negative pressure acting on the caps 65, 75 causes the air to be taken in from the through-holes 85, 95 and the through-holes 23, 24 of the valve seat 25 and also causes ink staying in the ink absorbing sheets 63, 64 and 73, 74 and the caps 65, 75 to be absorbed in the through-holes 84, 94 communicating with the pump unit 14 and discharged outside without making useless negative pressure acting on the nozzle opening orifices N1, N2 of the recording heads 7, 8. When the operation of discharging waste ink in the caps 65, 75 is completed, the pump unit 14 is stopped and the recording heads 7, 8 are moved to the printing area. During this process of moving the recording heads 7, 8, the rear end side of the slider 20 slides on the slope portion 31*c* of the base 30 by means of the contact piece 21 and the front end side is guided by the slope portion 32*c* of the base 30 by means of the contact piece 42 of the cap holder receiving member 40 and then lowered along the central portion while supported by the rotation of the lever 50. During the process of lowering the slider 20, the caps 65, 75 urged upward by the springs 61, 62 and 71, 72 respectively arrange in front and in the rear side are made to slightly tilt with the rear end side as the lower side and one end side in the width direction as the lower side. While the height and pressure contact force of the front end sides and the rear end sides of the caps 65, 75 are balanced by means of the rotation of the cap holder receiving member 40 around the central shaft 41, the thin-wall portions 102, 112 as sealing surfaces are made to follow the recording heads 7, 8 by the use of the swinging of the holders 60, 70 supported at three places of protrusions 66, 67 and 76, 77. Thus, the caps 65, 75 are separated from the surfaces of the recording heads 7, 8 while gradually increasing the contact areas from their rear end sides to one ends.

Figure 28I:
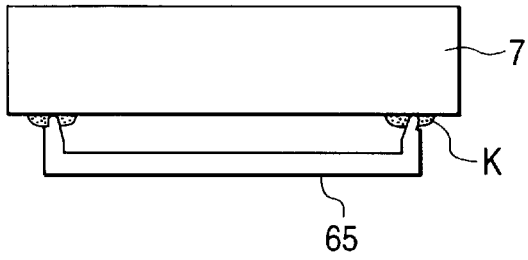
FIGS. 28(I)–28(IV) are diagrams illustrating phenomena in which ink is splashed when the caps are releasing by means of the capping units according to the present invention, respectively.
Figure 28:
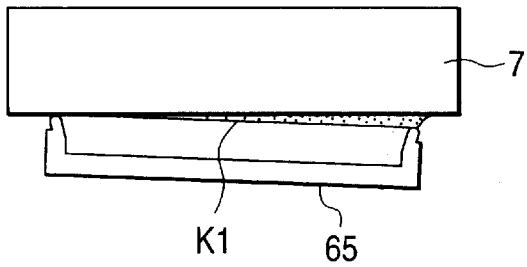
Figure 28:
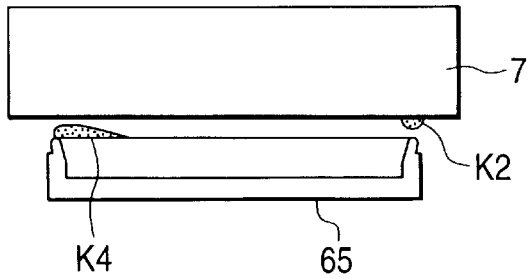

Since the recording heads 7, 8 are released from the caps 65, 75 while the open area is being gradually enlarged like this, moments act on the caps 65, 75 and the peeled area at every point of time is decreased as much as possible, whereby the caps 65, 75 sticking to the recording heads 7, 8 due to the solidified ink can be peeled off with a light load. When the recording heads 7, 8 are released from the caps 65, 75 by gradually enlarging the open area, ink stays at the boundary between the recording head 7 and the thin wall portion 102 of the cap as the ink is forced to be discharged, and ink K (FIG. 28(I)) stuck in a such a state as to cover the whole open face of the cap 65 (FIG. 28(8)) causes a film K1 to be formed (FIG. 28(II)). Consequently, ink splashes K1 are produced as they slightly burst as the gap in an area where the recording head 7 is initially separated from the cap 65 grows larger and most of the remaining ink K3 is directed (in the direction of an arrow F) to an area wherein the capillary force is greater and another area where the gap between the cap 65 and the recording head 7 is small (FIG. 28(III)). Consequently, the ink is accumulated into ink drops K4 at one point of the end portion where the caps 65, 75 are ultimately separated from the surfaces of the recording heads 7, 8 (FIG. 28(IV)). Therefore, the quantity of ink sticking to the nozzle plate is reducible and the printing quality is prevented from being lowered.

Figure 33I:
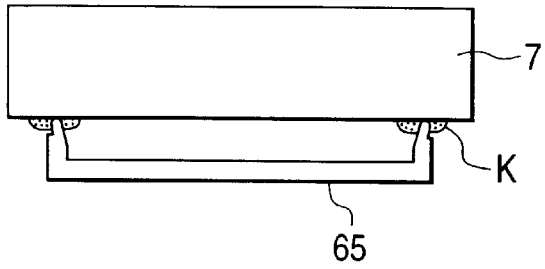
FIG. 33(I) PRIOR ART
FIGS. 33(I)–33(IV) are diagrams illustrating phenomena of ink splashing generated when a cap is released in a conventional capping unit.
Figure 33:
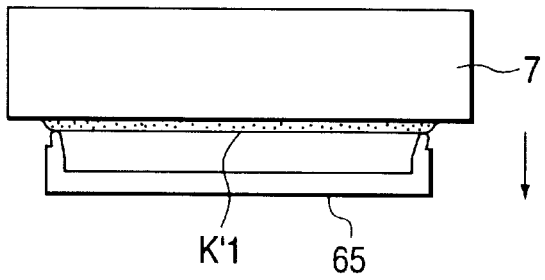
FIG. 33(II) PRIOR ART
Figure 33:
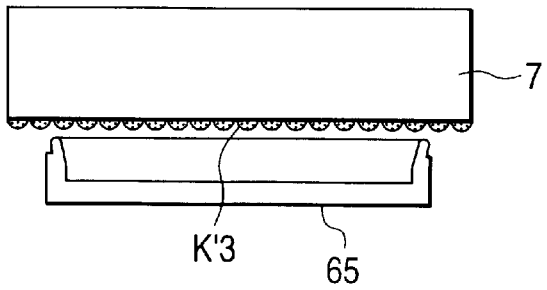
FIG. 33(IV) PRIOR ART

When the open face of the cap 65 is separated in parallel to the plane of the recording head 7, on the contrary, the ink K (FIG. 33(I)) stuck in such a manner as to cover the whole open face of the cap 65 is uniformly extended to form the film K1 of the size which is able to seal up the whole open face of the cap 65 (FIG. 33(II)). When the cap 65 is moved away from the recording 7, further, a film K2' is extended in the direction in which the cap is separated by following the movement of the cap (FIG. 33(III)). The ink film K2' ultimately bursts and the splashed ink K3' sticks over the whole surface of the recording head 87 to the thin wall portion 102 of the cap 65 (FIG. 33(IV)). The splashed ink K3' affects the wetting properties of ink in the nozzle opening orifice N1, thus inducing printing quality to lower.

Figure 29A:
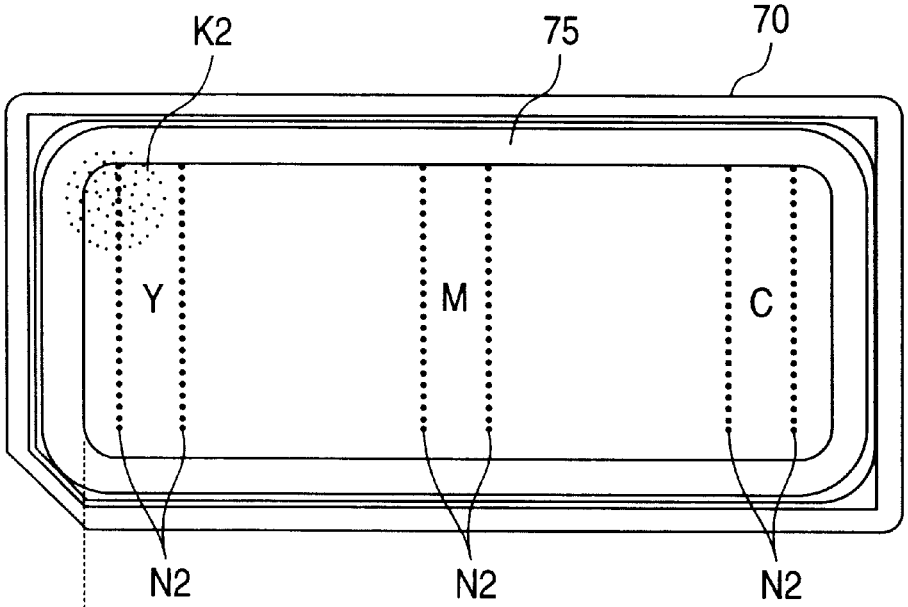
FIGS. 29(*a*) and 29(*b*) are diagrams showing a nozzle-opening orifice arrangement corresponding to the ink splashes caused at the time of releasing the caps, and a capping unit according to the embodiment of the present invention, respectively.
Figure 29A:
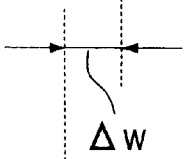
Figure 29B:
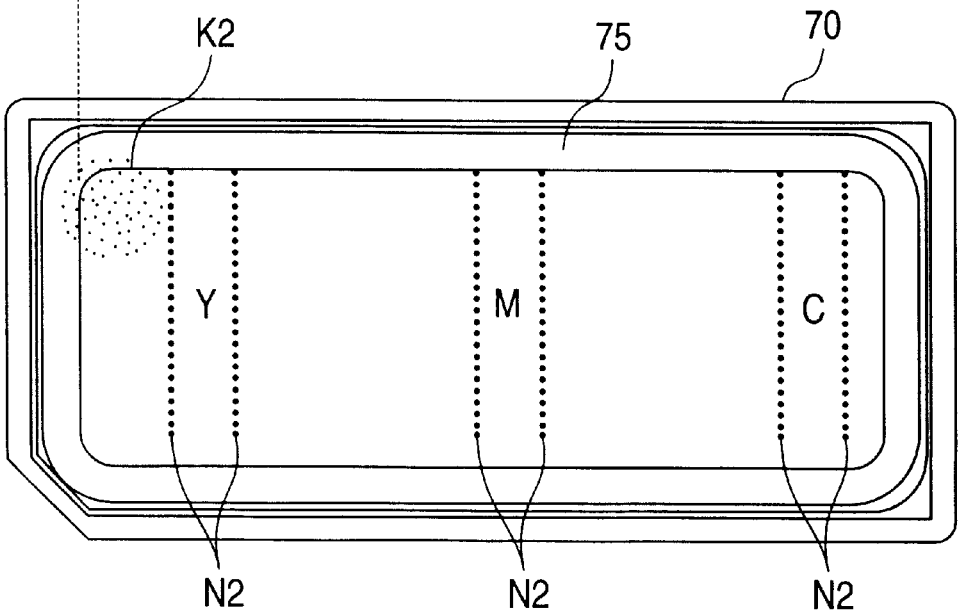

A small amount of ink is splashed in the aforementioned restricted area when the cap 65 is peeled off and in order that in the case of a color recording head 8 as shown in FIG. 29(*a*), color which does not affect printing with splashed ink, that is, the yellow (Y) nozzle opening orifice N2 is used or otherwise the nozzle opening orifice N2 is preferably placed apart by relatively increasing its length by a small amount $^{\Delta}$W up to the position which no splashed ink reaches as shown in FIG. 29(*b*). In the case where its length is increased like this, no restriction will be imposed on the color nozzle opening orifice.

Figure 30I:
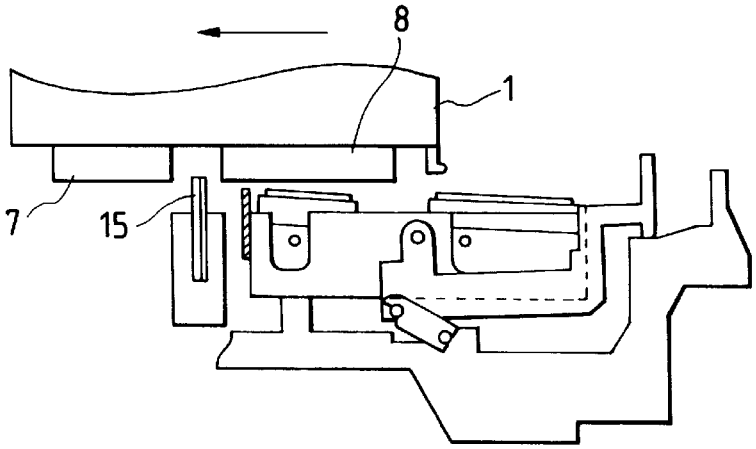
FIGS. 30(I)–30(III) are diagrams showing a cleaning operation to be performed by the capping unit according to the present invention.
Figure 30:
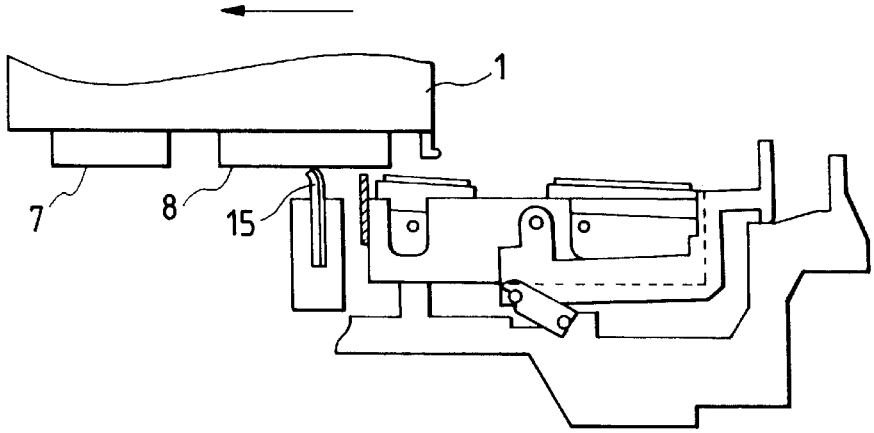
Figure 31A:
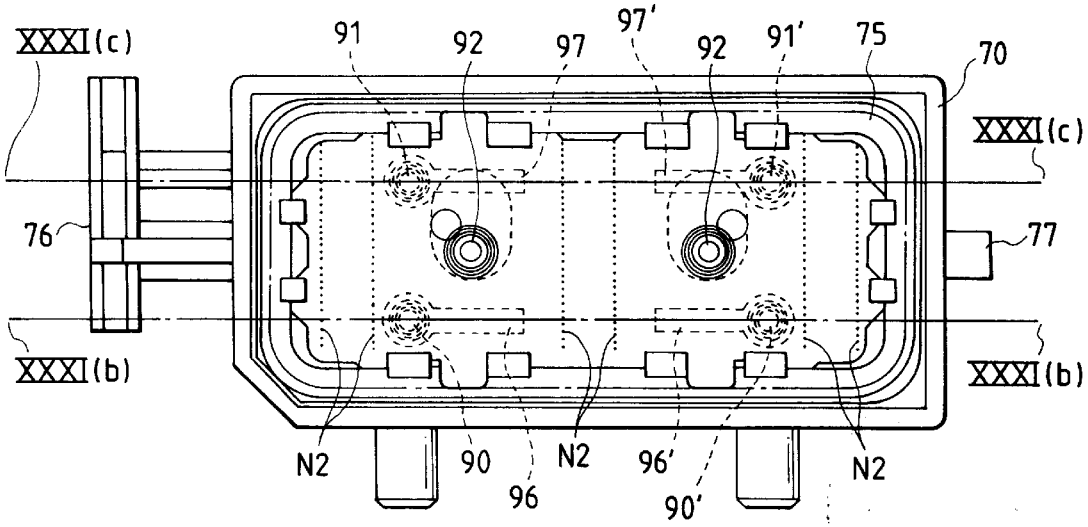
FIGS. 31(*a*), 31(*b*) and 31(*c*) are diagrams showing the surface structure of the second cap, a sectional structure taken along a line XXXI(b)—XXXI(b) and, what is taken on line XXXI(c)—XXXI(c), respectively.
Figure 31B:
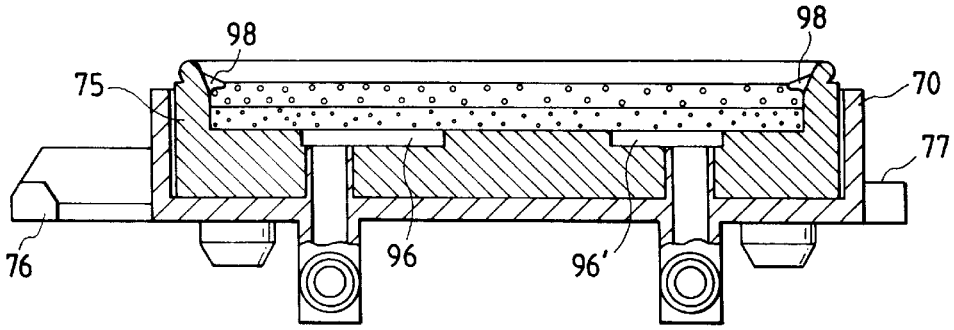
Figure 31C:
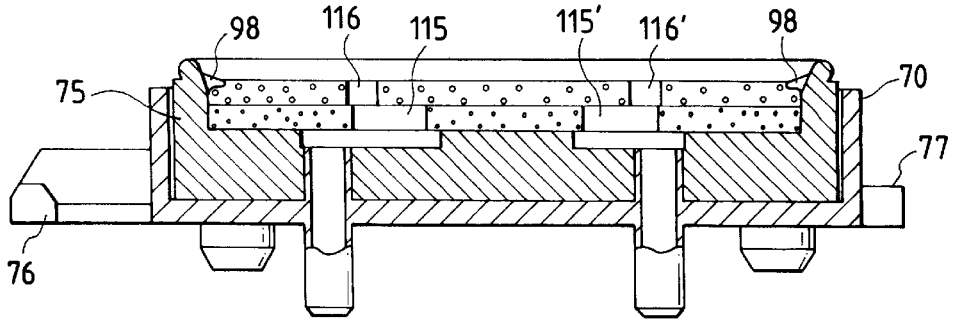

When the nozzle opening is cleaned as it is clogged with ink, the blade 15 is moved forward within the moving locus of the recording head 8 and then the carriage 1 is moved to the printing area side (FIG. 30(I)). The blade 15 is subjected to elastic deformation and brought into resilient contact with the surface of the moving second recording head 8 (FIG. 30(II)), whereby ink and ink dregs sticking thereto are wiped away. When the recording head 8 passes therethrough, the blade 15 bounds back without the support of the recording head 8 and part of the wiped ink in the form of splashes K is allowed to splash in the direction of the cap 65. However, the splashed ink is blocked by the ink-splash shielding plate 45 (FIG. 30(III)) and ink sticking to the thin wall portion 102 of the cap 65 is absorbed by the ink absorbing plate 46 (FIG. 17). Thus, ink splashes resulting from the cleaning operation are prevented from being solidified between the cap 60 and the recording head to ensure that it does not become unpeelable.

Although the pair of through-holes 84, 94 communicating with the pump unit 14 and the pair of through-holes 85, 95 communicating with the air are provided for the caps 65, 75 according to this embodiment of the present invention, tubes may be used to make the dummy through-holes 90', 91' respectively communicate with the pump unit 14 and the hole 24 of the valve seat 25 in the case of a especially large-sized cap 75, and through-holes 115', 116' also corresponding to the ink absorbing sheets 73, 74 are bored to ensure that waste ink in the ink absorbing sheets 73, 74 is discharged, irrespective of the size of the cap.

What is claimed is:

1. A capping unit comprising:

a cap holder receiving member which is pressed by a recording head or a carriage for carrying the recording head, a central portion of the cap holder receiving member is rotatably supported by a shaft perpendicularly intersecting a moving direction of the carriage within a plane in parallel to a plane including the moving direction of the carriage;

first and second cap holders each of which is urged toward the recording head by springs which are brought into contact with the cap holder receiving member at two places in the moving direction of the carriage and supported by the cap holder receiving member, said first and second cap holders having one point on a center line on a first end side of said first and second cap holders as a first contact point and two points holding the center line therebetween as second and third contact points on a second side of said first and second cap holders, wherein said third contact point is positioned higher on said first and second cap holders than said second contact point in a direction toward said recording head so that a distance from said second contact point to a surface of the recording head is greater than a distance from said third contact point to said surface of the recording head; and first and second caps respectively held by the first and second cap holders.

2. A capping unit as claimed in claim 1, wherein the spring disposed on the side where the distance from the recording head becomes greater is offset by the center line toward the side where the distance becomes greater.

3. A capping unit as claimed in claim 1, wherein the spring disposed on the side where the distance from the recording head becomes greater is set so that the spring force of the spring is greater than the spring force of the spring disposed on the other end side.

4. A capping unit as claimed in claim 1, wherein a distance between an edge portion of the cap whose distance from the recording head and the nozzle opening orifice of the recording head is set greater than the distance between the other edge portion of the cap and the nozzle opening orifice of the recording head.

5. A capping unit comprising:

a holder receiving member whose movement is interlocked with a movement of a recording head or a carriage for carrying the recording head, a central portion of the holder receiving member is rotatably supported;

first and second cap holders which are accommodated in the holder receiving member; and first and second caps which communicate with a pump unit and are accommodated in the first and second holders in such a manner that the first and second caps have predetermined gaps with respect to the first and second cap holders, respectively, wherein the gap is substantially defined such that the elastic deformation of the cap is absorbable when the recording head is sealed up by the cap.

6. A capping unit as claimed in claim 5, wherein the gap ranges from 0.2 to 1 millimeter.

7. A capping unit as claimed in claim 5, wherein the cap is formed of rubber whose hardness ranges from 50 to 60 degrees and wherein the gap is approximately 0.4 mm.

8. A capping unit as claimed in claim 5, wherein the gap is between the holder and the central portion of the cap on its long side.

9. A capping unit as claimed in claim 8, wherein a protrusion protruding toward the cap side is formed in the central portion of the cap on at least its long side.

10. A capping unit as claimed in claim 8, wherein a protrusion is formed on the bottom of the holder and wherein a recess engaging with the protrusion is formed in the bottom of the cap.

11. A capping unit as claimed in claim 10, wherein the protrusion is formed as a cylindrical body for forming a communication channel for connecting an atmospheric open valve and the pump unit and wherein the recess is formed as a through-hole.

12. A capping unit as claimed in claim 5, wherein a protrusion is formed on the inner peripheral face of the holder and wherein a recess engaging with the protrusion is formed on the outer peripheral face of the cap.

13. A capping unit comprising:

a holder receiving member;

a cap accommodated in said holder receiving member to be pressed by a recording head or a carriage for carrying the recording head, wherein said cap is connected to an atmospheric open valve or a pump unit via tubes which are so twisted as to become parallel to a plane extending in the moving direction of the carriage, wherein the tubes are mutually directed in a same direction.

14. A capping unit as claimed in claim 13, wherein the tubes are so twisted as to be mutually directed outside.

15. A capping unit as claimed in claim 13, wherein the pump unit is a tube pump.

16. A capping unit as claimed in claim 13, wherein the other end of the tube connected to the atmospheric open valve is connected vertically to the bottom of the holder.

17. A capping unit as claimed in claim 13, wherein the central portion of the holder receiving member is supported by a shaft perpendicularly intersecting the moving direction of the carriage in a plane parallel to a plane including the moving direction of the carriage and wherein two caps are accommodated with the shaft held therebetween.

18. A capping unit as claimed in claim 17, wherein the tube connected to the holder positioned on the remote side from the atmospheric open valve is secured to the side face of the slider and wherein the tube connected to the holder position on the close side of the atmospheric open valve is curved so that the tube becomes substantially parallel to a plain perpendicularly intersecting the moving direction of the slider.

19. A capping unit comprising:

a holder receiving member which is pressed by a recording head or a carriage for carrying the recording head to move, a central portion of the holder receiving member being rotatably supported by a shaft perpendicularly intersecting the moving direction of the carriage; and first and second caps which are urged by springs in contact with the holder receiving member toward the recording head at two places in the moving direction of the carriage and held by a first and a second holder accommodated in the holder receiving member.

20. A capping unit as claimed in claim 19, wherein the shaft is provided in a position where the moments of the springs for urging the first and second holders are balanced.

21. A capping unit as claimed in claim 19, wherein the springs are positioned on a center line of the first and second holders and so disposed as to be brought into contact with the proximity of both ends of the first and second holders.

22. A capping unit in claim 19, wherein the first and second holders are supported by the holder receiving member, said first and second holders having one point on a first end side of said first and second holders on a center line as a first contact point and two points holding the center line therebetween on another end side of said first and second holders as second and third contact points and wherein the spring is so disposed as to be within an area connecting the three points.

23. A capping unit as claimed in claim 19, wherein the diameter of the spring is not smaller than ⅓ of a length of a short side of the holder.

24. A capping unit comprising:

a cap holder receiving member whose movement is interlocked with the movement of a recording head or a carriage for carrying the recording head, a central portion of the cap holder receiving member is rotatably supported by a shaft perpendicularly intersecting the moving direction of a carriage;

first and second cap holders which are accommodated in the holder receiving member; and first and second caps which are urged by springs toward the recording head at two places in the moving direction of the carriage and accommodated in the cap holder receiving member in such a manner as to be symmetrical with respect to the shaft.

25. A capping unit as claimed in claim 24, wherein an end portion on the capping position side of the slider and the end portion of the non-capping position side of the holder receiving member are respectively guided by slopes formed on the base with the non-capping side as an upper side and wherein the central portion of the slider is rotatably supported by an arm provided between the central portion and the base and also moved up and down in response to the movement of the carriage.

26. A capping unit as claimed in claim 24, wherein the slider is urged by the spring stretched between the end portion on the capping position side and the central area of the base on the non-capping position side toward the base side and wherein the holder receiving member is urged by the spring stretched between the end portion on the non-capping position side and the slider toward the capping side.

27. A capping unit as claimed in claim 24, wherein the first and second caps are accommodated in the holder receiving member in such a state that their capping position sides are expansively tilted.

28. A capping unit as claimed in claim 24, wherein the holder receiving member is mounted on the slider so that only one corners of the first and second caps protrude toward the recording head side.

29. A capping unit as claimed in claim 24, wherein the holder receiving member is brought into contact with the slider at one point of the central portion on one end side in the moving direction of the carriage and at two points on the other end side.

30. A capping unit as claimed in claim 24, wherein the holder receiving member is pivotally held at one point on the center line of one side wall in the moving direction of the carriage, and the other side wall is held at two points across the center line of the holder receiving member.

31. A capping unit as claimed in claim 24, wherein an ink absorbing sheet accommodated in the holder is secured to the holder with rivets.

32. A capping unit as claimed in claim 24, wherein through-holes for absorbing an increased volume at the time of swelling are bored in the ink absorbing sheet.

33. A capping unit as claimed in claim 24, wherein cutouts for absorbing an increased volume at a time of swelling are bored in an ink absorbing sheet.

34. An ink-jet recording apparatus comprising:

a carriage;

an ink-jet recording head installed on said carriage; and a capping unit in a non-printing area, the capping unit comprising:

a cap holder receiving member which is pressed by a recording head or a carriage for carrying the recording head, a central portion of the holder receiving member is rotatably supported by a shaft perpendicularly intersecting the moving direction of the carriage within a plane in parallel to a plane including the moving direction of the carriage;

first and second cap holders each of which is urged toward the recording head by a spring which is brought into contact with the cap holder receiving member at two places in the moving direction of the carriage and supported by the holder receiving member, said first and second cap holders having one point on a center line on a first end side of said first and second cap holders as a first contact point and two points holding the center line therebetween as second and third contact point on a second end of said first and second cap holders, a distance from said second contact point to a surface of the recording head is greater than a distance from said third contact point to said surface of the recording head; and first and second caps respectively held by the first and second cap holders.

35. An ink-jet recording apparatus as claimed in claim 34, wherein the spring disposed on the side where the distance from the recording head becomes greater is offset by the center line toward the side where the distance becomes greater.

36. An ink-jet recording apparatus as claimed in claim 34, wherein the spring disposed on the side where the distance from the recording head becomes greater is set so that the spring force of the spring is greater than the spring force of the spring disposed on the other end side.

37. An ink-jet recording apparatus as claimed in claim 34, wherein a distance between an edge portion of the cap whose distance from the recording head and the nozzle opening orifice of the recording head is set greater than the distance between the other edge portion of the cap and the nozzle opening orifice of the recording head.

38. An ink-jet recording apparatus comprising:

a carriage;

an ink-jet recording head installed on said carriage; and a capping unit in a non-printing area, the capping unit comprising:

a holder receiving member whose movement is interlocked with the movement of a recording head or a carriage for carrying the recording head, a central portion of the holder receiving member being rotatably supported;

first and second cap holders which are accommodated in the holder receiving member; and first and second caps which communicate with a pump unit and are accommodated in the first and second holders in such a manner that the first and second caps have predetermined gap with respect to the first and second holders, respectively, wherein the gap is substantially defined such that the elastic deformation of the cap is absorbable when the recording head is sealed up by the cap.

39. An ink-jet recording apparatus as claimed in claim 38, wherein the gap ranges from 0.2 to 1 millimeter.

40. An ink-jet recording apparatus as claimed in claim 38, wherein the cap is formed of rubber whose hardness ranges from 50 to 60 degrees and wherein the gap is approximately 0.4 mm.

41. An ink-jet recording apparatus as claimed in claim 38, wherein the gap is between the holder and the central portion of the cap on its long side.

42. An ink-jet recording apparatus as claimed in claim 38, wherein a protrusion protruding toward the cap side is formed in the central portion of the cap on at least its long side.

43. An ink-jet recording apparatus as claimed in claim 38, wherein a protrusion is formed on the bottom of the holder and wherein a recess engaging with the protrusion is formed in the bottom of the cap.

44. An ink-jet recording apparatus as claimed in claim 43, wherein the protrusion is formed as a cylindrical body for forming a communication channel for connecting an atmospheric open valve and the pump unit and wherein the recess is formed as a through-hole.

45. An ink-jet recording apparatus as claimed in claim 38, wherein a protrusion is formed on the inner peripheral face of the holder and wherein a recess engaging with the protrusion is formed on the outer peripheral face of the cap.

46. An ink-jet recording apparatus comprising:

a carriage;

an ink-jet recording head installed on said carriage; and a capping unit in a non-printing area, wherein said capping unit comprises;

a holder receiving member; and a cap accommodated in said holder receiving member to be pressed by said recording head or said carriage for carrying the recording head, wherein said cap is connected to an atmospheric open valve or a pump unit via tubes which are so twisted as to become parallel to a plane extending in the moving direction of the carriage, wherein the tubes are mutually directed in a same direction.

47. An ink-jet recording apparatus as claimed in claim 46, wherein the tubes are so twisted as to be mutually directed outside.

48. An ink-jet recording apparatus as claimed in claim 46, wherein the pump unit is a tube pump.

49. An ink-jet recording apparatus as claimed in claim 46, wherein the other end of the tube connected to the atmospheric open valve is connected vertically to the bottom of the holder.

50. An ink-jet recording apparatus as claimed in claim 46, wherein the central portion of the holder receiving member is supported by a shaft perpendicularly intersecting the moving direction of the carriage in a plane parallel to a plane including the moving direction of the carriage and wherein two caps are accommodated with the shaft held therebetween.

51. An ink-jet recording apparatus as claimed in claim 50, wherein the tube connected to the holder positioned on a remote side from the atmospheric open valve is secured to the side face of the slider and wherein the tube connected to the holder position on the close side of the atmospheric open valve is curved so that the tube becomes substantially parallel to a plain perpendicularly intersecting the moving direction of the slider.

52. An ink-jet recording apparatus comprising:

a carriage;

an ink-jet recording head installed on said carriage; and a capping unit in a non-printing area, the capping unit comprising:

a cap holder receiving member which is pressed by a recording head or a carriage for carrying the recording head to move, a central portion of the holder receiving member being rotatably supported by a shaft perpendicularly intersecting the moving direction of the carriage; and first and second caps which are urged by springs in contact with the holder receiving member toward the recording head at two places in the moving direction of the carriage and held by a first and a second holder accommodated in the holder receiving member.

53. An ink-jet recording apparatus as claimed in claim 52, wherein the shaft is provided in a position where the moments of the springs for urging the first and second holders are balanced.

54. An ink-jet recording apparatus as claimed in claim 52, wherein the springs are positioned on a center line of the first and second holders and so disposed as to be brought into contact with the proximity of both ends of the first and second holders.

55. An ink-jet recording apparatus as claimed in claim 52, wherein the first and second holders are supported by the holder receiving member with one point on one end side on a center line as a contact point and two points holding the center line therebetween on another end side as a contact point and wherein the spring is so disposed as to be within an area connecting the three points.

56. An ink-jet recording apparatus as claimed in claim 52, wherein the diameter of the spring is not smaller than ⅓ of a length of a short side of the holder.

57. An ink-jet recording apparatus comprising:

a carriage;

an ink-jet recording head installed on said carriage; and a capping unit in a non-printing area, the capping unit comprising:

a cap holder receiving member whose movement is interlocked with a movement of a recording head or a carriage for carrying a recording head, a central portion of the cap holder receiving member is rotatably supported by a shaft perpendicularly intersecting the moving direction of a carriage;

first and second cap holders which are accommodated in the cap holder receiving member; and a first and a second cap which are urged by springs toward the recording head at two places in the moving direction of the carriage and accommodated in the holder receiving member in such a manner as to be symmetrical with respect to the shaft.

58. An ink-jet recording apparatus as claimed in claim 57, wherein the end portion on the capping position side of the slider and the end portion of the non-capping position side of the holder receiving member are respectively guided by slopes formed on the base with the non-capping side as an upper side and wherein the central portion of the slider is rotatably supported by an arm provided between the central portion and the base and also moved up and down in response to the movement of the carriage.

59. An ink-jet recording apparatus as claimed in claim 57, wherein the slider is urged by the spring stretched between the end portion on the capping position side and the central area of the base on the non-capping position side toward the base side and wherein the holder receiving member is urged by the spring stretched between the end portion on the non-capping position side and the slider toward the capping side.

60. An ink-jet recording apparatus as claimed in claim 57, wherein the first and second caps are accommodated in the holder receiving member in such a state that their capping position sides are expansively tilted.

61. An ink-jet recording apparatus as claimed in claim 57, wherein the holder receiving member is mounted on the slider so that only one corner of the first and second caps protrude toward the recording head side.

62. An ink-jet recording apparatus as claimed in claim 57, wherein the holder receiving member is brought into contact with the slider at one point of the central portion on one end side in the moving direction of the carriage and at two points on the other end side.

63. An ink-jet recording apparatus as claimed in claim 57, wherein the holder receiving member is pivotally held at one point on the center line of one side wall in the moving direction of the carriage, and the other side wall is held at two points across the center line of the holder receiving member.

64. An ink-jet recording apparatus as claimed in claim 57, wherein an ink absorbing sheet accommodated in the holder is secured to the holder with rivets.

65. An ink-jet recording apparatus as claimed in claim 57, wherein through-holes for absorbing an increased volume at the time of swelling are bored in the ink absorbing sheet.

66. An ink-jet recording apparatus as claimed in claim 57, wherein cutouts for absorbing an increased volume at a time of swelling are bored in an ink absorbing sheet.

* * * * *